US008785094B2

(12) United States Patent
Sato et al.

(10) Patent No.: US 8,785,094 B2
(45) Date of Patent: Jul. 22, 2014

(54) ELECTROSTATIC LATENT IMAGE DEVELOPING TONER, ELECTROSTATIC LATENT IMAGE DEVELOPER, TONER CARTRIDGE, PROCESS CARTRIDGE, IMAGE FORMING APPARATUS, AND IMAGE FORMING METHOD

(75) Inventors: Shuji Sato, Kanagawa (JP); Atsushi Sugitate, Kanagawa (JP); Masaru Takahashi, Kanagawa (JP); Shotaro Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/564,256

(22) Filed: Aug. 1, 2012

(65) Prior Publication Data

US 2013/0244163 A1 Sep. 19, 2013

(30) Foreign Application Priority Data

Mar. 13, 2012 (JP) ..... 2012-055934

(51) Int. Cl.
*G03G 9/08* (2006.01)

(52) U.S. Cl.
USPC ..... 430/108.3; 430/110.1; 399/252

(58) Field of Classification Search
USPC ..... 430/108.3, 110.1; 399/252
See application file for complete search history.

(56) References Cited

U.S. PATENT DOCUMENTS

| | | | |
|---|---|---|---|
| 4,976,777 | A | 12/1990 | Ozawa et al. |
| 5,062,886 | A | 11/1991 | Ozawa et al. |
| 5,198,320 | A | 3/1993 | Vreeland et al. |
| 5,480,481 | A | 1/1996 | Setoguchi et al. |
| 5,482,808 | A | 1/1996 | Kondo et al. |
| 5,753,392 | A | 5/1998 | Ray et al. |
| 5,910,388 | A | 6/1999 | Ray et al. |
| 6,017,670 | A | 1/2000 | Hashizume et al. |
| 6,245,140 | B1 | 6/2001 | Monden et al. |
| 6,281,277 | B1 | 8/2001 | Ishii et al. |
| 7,267,920 | B2 | 9/2007 | Nakazawa et al. |
| 7,413,841 | B2 | 8/2008 | Yuasa |
| 2001/0018157 | A1 | 8/2001 | Aoki et al. |

(Continued)

FOREIGN PATENT DOCUMENTS

| | | |
|---|---|---|
| EP | 2 047 335 B1 | 5/2011 |
| JP | A-62-067558 | 3/1987 |

(Continued)

OTHER PUBLICATIONS

U.S. Appl. No. 12/943,630, filed Nov. 10, 2010, first named inventor Yasuo Kadokura.

(Continued)

*Primary Examiner* — Mark A. Chapman
(74) *Attorney, Agent, or Firm* — Oliff PLC

(57) ABSTRACT

An electrostatic latent image developing toner contains toner particles that contain a binder resin and a pigment; and an external additive that contains inorganic particles, a ratio (C/D) of an average maximum thickness C to an average equivalent circle diameter D in the toner particles is from 0.05 to 0.7, the inorganic particles include silicone oil-treated inorganic particles in which the amount of free silicone oil with respect to the inorganic particles is from 0.1% by weight to 10% by weight, and the amount of the silicone oil-treated inorganic particles added with respect to 100 parts by weight of the toner particles is from 0.1 part by weight to 10 parts by weight.

19 Claims, 2 Drawing Sheets

(56) References Cited

U.S. PATENT DOCUMENTS

| | | | | |
|---|---|---|---|---|
| 2002/0192585 | A1 | 12/2002 | Brenner et al. | |
| 2005/0214669 | A1 | 9/2005 | Hayashi et al. | |
| 2006/0093937 | A1 | 5/2006 | Grinwald | |
| 2007/0059626 | A1 | 3/2007 | Inoue et al. | |
| 2007/0072103 | A1 | 3/2007 | Kawamura et al. | |
| 2007/0141498 | A1 | 6/2007 | Umehara | |
| 2007/0207397 | A1 | 9/2007 | Julien | |
| 2008/0118280 | A1 | 5/2008 | Han et al. | |
| 2008/0131802 | A1 | 6/2008 | Mizutani et al. | |
| 2008/0182198 | A1 | 7/2008 | Kawamura et al. | |
| 2008/0193868 | A1 | 8/2008 | Schuster et al. | |
| 2008/0277490 | A1 | 11/2008 | Kinoshita et al. | |
| 2009/0029278 | A1 | 1/2009 | OP De Beeck et al. | |
| 2009/0103950 | A1 | 4/2009 | Nakayama et al. | |
| 2009/0111040 | A1 | 4/2009 | Veregin et al. | |
| 2009/0288580 | A1 | 11/2009 | Cai | |
| 2010/0183964 | A1 | 7/2010 | Yoshida et al. | |
| 2010/0330487 | A1 | 12/2010 | Veregin et al. | |
| 2011/0065034 | A1 | 3/2011 | Arima et al. | |
| 2011/0262654 | A1* | 10/2011 | Yates et al. | 427/532 |
| 2011/0262858 | A1* | 10/2011 | Nair et al. | 430/110.2 |
| 2011/0318682 | A1* | 12/2011 | Takahashi et al. | 430/110.1 |
| 2011/0318683 | A1 | 12/2011 | Kadokura et al. | |
| 2013/0078562 | A1 | 3/2013 | Takahashi et al. | |

FOREIGN PATENT DOCUMENTS

| | | |
|---|---|---|
| JP | A-62-100769 | 5/1987 |
| JP | A-02-073872 | 3/1990 |
| JP | A-6-57171 | 3/1994 |
| JP | A-09-106094 | 4/1997 |
| JP | A-9-302257 | 11/1997 |
| JP | A-10-324505 | 12/1998 |
| JP | A-2000-7941 | 1/2000 |
| JP | A-2000-221780 | 8/2000 |
| JP | A-2003-29444 | 1/2003 |
| JP | A-2003-213157 | 7/2003 |
| JP | A-2006-039475 | 2/2006 |
| JP | A-2010-072334 | 4/2010 |
| JP | A-2010-256613 | 11/2010 |
| WO | WO 2006/041658 | 4/2006 |
| WO | WO 2009/026360 A2 | 2/2009 |

OTHER PUBLICATIONS

Oct. 11, 2012 Office Action issued in U.S. Appl. No. 12/943,630.
Diamond et al., "Handbook of Imaging Materials," Second Edition, Marcel Dekker, Inc., (2002), pp. 145-164, NY, USA.
Aug. 7, 2013 Office Action issued in U.S. Appl. No. 12/943,630.
Tony Whelan, "Polymer Technology Dictionary," Second Edition 1994, p. 256, Chapman & Hall, London, UK.
Apr. 11, 2013 Office Action issued in U.S. Appl. No. 12/943,630.
May 16, 2013 Office Action issued in U.S. Appl. No. 12/955,302.
Dec. 17, 2012 Office Action issued in U.S. Appl. No. 12/907,313.
Jan. 23, 2013 Office Action issued in U.S. Appl. No. 12/955,302.
U.S. Appl. No. 12/907,313 to Takahashi et al. filed Oct. 19, 2010.
U.S. Appl. No. 12/955,302 to Takahashi et al. filed Nov. 29, 2010.
Nov. 23, 2012 Office Action issued in Australian Patent Application No. 2012200768, pp. 1-4.
Oct. 11, 2013 Notice of Allowance issued in U.S. Appl. No. 12/955,302.
Jun. 21, 2013 Office Action issued in U.S. Appl. No. 13/364,095.
Jul. 1, 2013 Office Action issued in U.S. Appl. No. 13/532,231.
Aug. 14, 2013 Office Action issued in U.S. Appl. No. 13/454,597.
U.S. Appl. No. 13/454,597 to Nakashima et al. filed Apr. 24, 2012.
U.S. Appl. No. 13/532,231 Sugitate et al. filed Jun. 25, 2012.
U.S. Appl. No. 13/364,095 Takahashi et al. filed Feb. 1, 2012.
U.S. Appl. No. 13/469,642 Sato et al. filed May 11, 2012.
Nov. 13, 2013 Office Action issued in U.S. Appl. No. 13/469,642.
Briggs et al., "The Effects of Fusing on Gloss in Electrophotography," IS&T's NIP14 International Conference on Digital Printing Technologies, Oct. 18-23, 1998, Toronto, Ontario, Canada.
Pettersson et al. "Leveling During Toner Fusing: Effects on Surface Roughness and Gloss of Printed Paper," Journal of Imaging Science and Technology 50 (2), pp. 202-215, 2006.
Nov. 22, 2013 Office Action issued in U.S. Appl. No. 12/943,630.
Dec. 4, 2013 Office Action issued in U.S. Appl. No. 13/364,095.
Dec. 19, 2013 Office Action issued in U.S. Appl. No. 13/454,597.
Mar. 27, 2014 Office Action issued in U.S. Appl. No. 13/454,597.

* cited by examiner

ELECTROSTATIC LATENT IMAGE DEVELOPING TONER, ELECTROSTATIC LATENT IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-055934 filed Mar. 13, 2012.

BACKGROUND

1. Technical Field

The present invention relates to an electrostatic latent image developing toner, an electrostatic latent image developer, a toner cartridge, a process cartridge, an image forming apparatus, and an image forming method.

2. Related Art

In electrophotography, generally, image formation is performed through plural processes including: electrically forming a latent image using various means on a surface of a photoreceptor (electrostatic latent image holding member) using a photoconductive material; developing the formed latent image using a developer including a toner to form a developed image; transferring the developed image to a recording medium such as paper via an intermediate transfer member as necessary; and fixing the transferred image by heating, pressurization, heating pressurization, or the like.

As the toner that is used for image formation, a toner that contains toner particles containing a binder resin and a colorant; and an external additive externally added to the toner particles is used in many cases.

SUMMARY

According to an aspect of the invention, there is provided an electrostatic latent image developing toner containing toner particles that contain a binder resin and a pigment; and an external additive that contains inorganic particles, wherein a ratio (C/D) of an average maximum thickness C to an average equivalent circle diameter D in the toner particles is from 0.05 to 0.7, the inorganic particles include silicone oil-treated inorganic particles in which the amount of free silicone oil with respect to the inorganic particles is from 0.1% by weight to 10% by weight, and the amount of the silicone oil-treated inorganic particles added with respect to 100 parts by weight of the toner particles is from 0.1 part by weight to 10 parts by weight.

BRIEF DESCRIPTION OF THE DRAWINGS

Exemplary embodiments of the present invention will be described in detail based on the following figures, wherein.

DETAILED DESCRIPTION

Figure 1:
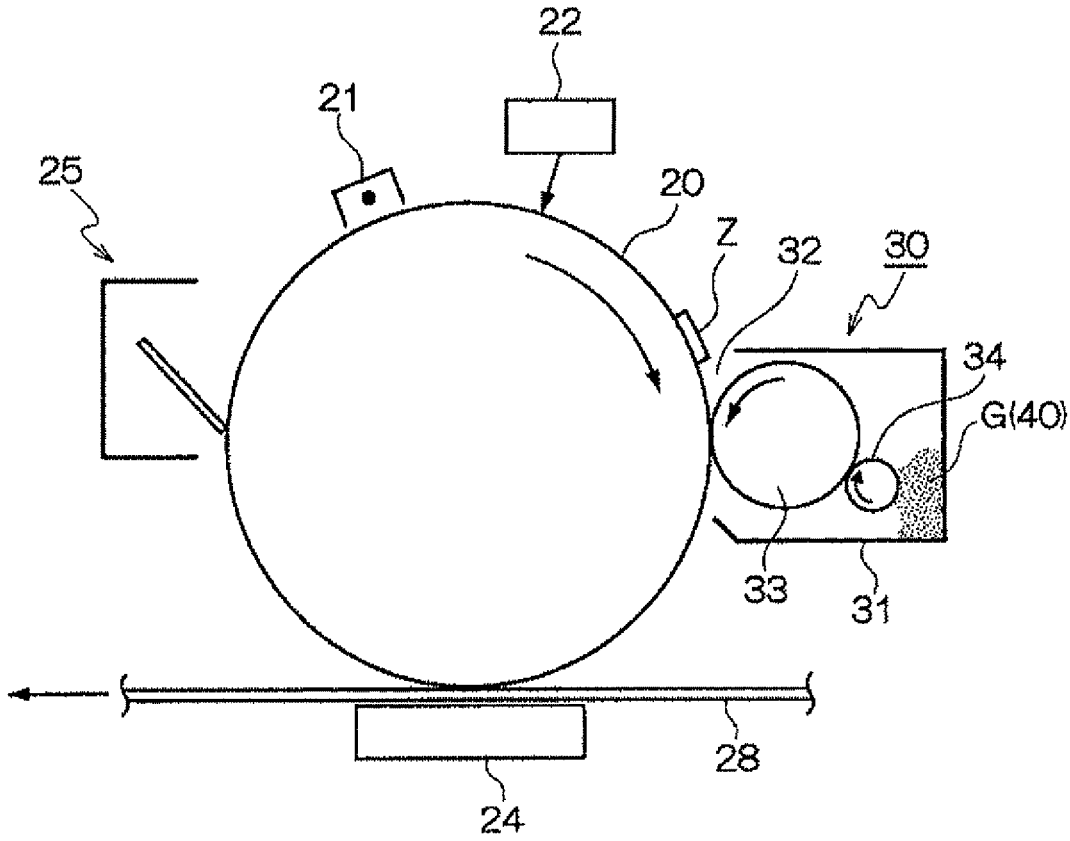
FIG. 1 is a schematic diagram showing the configuration of an image forming apparatus to which an exemplary embodiment is applied.

Hereinafter, an electrostatic latent image developing toner, an electrostatic latent image developer, a toner cartridge, a process cartridge, and an image forming apparatus according to an exemplary embodiment of the invention will be described in detail.

Electrostatic Latent Image Developing Toner

An electrostatic latent image developing toner according to this exemplary embodiment contains toner particles in which a ratio (C/D) of an average maximum thickness C to an average equivalent circle diameter D is from 0.05 to 0.7, and silicone oil-treated inorganic particles in which the amount of free silicone oil with respect to the inorganic particles is from 0.1% by weight to 10% by weight. The amount of the silicone oil-treated inorganic particles added with respect to 100 parts by weight of the toner particles is from 0.1 part by weight to 10 parts by weight.

Hereinafter, the electrostatic latent image developing toner according to this exemplary embodiment will be simply referred to as "toner", the toner particles will be referred to as toner particles (a), and the silicone oil-treated inorganic particles will be referred to as inorganic particles (b).

The electrostatic latent image developing toner according to this exemplary embodiment having the above-described configuration suppresses partial wear and scratches of a cleaning blade.

The reason for this is not clear, but is likely to be as follows.

In the case of a toner containing a bright pigment as a colorant, it is necessary to efficiently arrange the bright pigment on a recording medium in order to obtain a sufficiently bright image. Therefore, as the bright pigment, a plate-like pigment having a flat shape and a large particle diameter is used. The toner particles containing such a bright pigment have a flat shape derived from the shape of the bright pigment.

Regardless of the inclusion of the bright pigment, the toner containing flat toner particles has a large contact area with respect to a photoreceptor (image holding member) due to its shape when being used in image formation, and thus the toner easily remains on a surface of the photoreceptor. Since the remaining toner is accumulated in a part in which the photoreceptor and the cleaning blade are brought into contact with each other, the torque that is applied to the cleaning blade increases, and as a result, partial wear and scratches due to peeling are caused on the cleaning blade.

In order to resolve the problem, there is a method using a toner in which an external additive such as silica or titanium is applied to toner particles. However, when the toner particles have a flat shape, particularly, when the toner particles have a flat shape and surface unevenness, external additives that have been used in the past are not easily uniformly adhered to the surfaces of the toner particles, and do not resolve the above-described problem continuously.

Accordingly, the toner according to this exemplary embodiment uses, as an external additive, silicone oil-treated inorganic particles in which the amount of free silicone oil with respect to the inorganic particles is from 0.1% by weight to 10% by weight with respect to flat toner particles in which a ratio (C/D) of an average maximum thickness C to an average equivalent circle diameter D is from 0.05 to 0.7.

In the silicone oil-treated inorganic particles, the silicone oil is partially separated from the inorganic particulates and functions as an adhesive, and thus it adheres to and is fixed to the surfaces of the toner particles. Therefore, even when the toner particles have a flat shape, it is thought that the silicone oil-treated inorganic particles may effectively coat the surfaces of the toner particles. In addition, since the silicone oil is partially separated from the silicone oil-treated inorganic particles, it is thought that the silicone oil is supplied to the surfaces of the toner particles and other components, and also supplied to an image forming apparatus (particularly, photoreceptor and cleaning blade).

For these reasons, even when the toner contains flat toner particles, the toner is suppressed from adhering to the photoreceptor and from remaining on the surface of the photoreceptor, and as a result, it is assumed that partial wear and scratches due to peeling may be suppressed from being caused on the cleaning blade.

Toner Particles (a)

In the toner particles (a) according to this exemplary embodiment, a ratio (C/D) of an average maximum thickness C to an average equivalent circle diameter D is from 0.05 to 0.7.

That is, the toner particles (a) are characterized in that the average equivalent circle diameter D is longer than the average maximum thickness C, the ratio (C/D) is in the above range, and the particles have a flat shape.

The ratio (C/D) of the average maximum thickness C to the average equivalent circle diameter D is more preferably from 0.05 to 0.7, even more preferably from 0.1 to 0.6, and particularly preferably from 0.2 to 0.5.

When the ratio (C/D) is 0.05 or greater, the strength of the toner is secured, fracture due to stress in image formation is suppressed, charging due to the exposure of the pigment is reduced, and the resulting fogging is suppressed. Moreover, when the ratio (C/D) is 0.7 or less, the toner shape is flat, and regular reflection light is increased, whereby excellent brilliance is obtained.

The average maximum thickness C and the average equivalent circle diameter D of the toner particles (a) are measured using the following method.

First, toner particles are put on a flat, smooth surface, and dispersed evenly by applying a vibration. Using a color laser microscope "VK-9700" (manufactured by Keyence Corporation), 1,000 toner particles are magnified 1,000 times to measure a maximum thickness C and an equivalent circle diameter D of the surface viewed from above, and arithmetic mean values of the measured values are obtained to calculate the average maximum thickness C and the average equivalent circle diameter D.

Next, the materials of the toner particles (a) will be described.

The toner particles (a) contains at least a binder resin, and as necessary, a colorant, a release agent, and other additives (internal additives).

Binder Resin

Examples of a binder resin of the toner particles (a) include polyolefin resins such as polyethylene, and polypropylene; styrene resins such as polystyrene and α-polymethylstyrene; (meth)acryl resins such as polymethyl methacrylate and polyacrylonitrile; polyester; polyamide resins; polycarbonate resins; polyether resins, and copolymer resins thereof. Among them, a polyester resin is preferably used.

In the following description, a polyester resin that is particularly preferably used will be described.

Typically, the polyester resin is obtained by, for example, condensation polymerization of polyvalent carboxylic acids and polyols.

Examples of polyvalent carboxylic acids include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. One or two or more types of the polyvalent carboxylic acids are used.

Among the polyvalent carboxylic acids, aromatic carboxylic acids are preferably used. In addition, in order to employ a crosslinked structure or a branched structure to secure good fixability, tri- or higher-valent carboxylic acids (trimellitic acid and its acid anhydride) are preferably used in combination together with dicarboxylic acids.

Examples of polyols include aliphatic diols such as ethylene glycol, diethylene glycol, triethylene glycol, propylene glycol, butanediol, hexanediol, neopentylglycol, and glycerin; alicyclic dials such as cyclohexanediol, cyclohexane dimethanol, and hydrogenated bisphenol-A; and aromatic dials such as an ethylene oxide adduct of bisphenol A and a propylene oxide adduct of bisphenol A. One or two or more types of the polyols are used.

Among the polyols, aromatic dials and alicyclic dials are preferably used, and aromatic dials are mare preferably used. In addition, in order to employ a crosslinked structure or a branched structure to secure more suitable fixability, tri- or higher-valent polyols (glycerin, trimethylol propan, and pentaerythritol) may be used in combination together with dials.

A "Polyester resin" of this exemplary embodiment is a resin exhibiting a step-like change in the amount of heat absorption in Differential Scanning calorimetry (hereinafter, sometimes referred to as "DSC").

In this exemplary embodiment, the molecular weight of the polyester resin is measured and calculated by Gel Permeation Chromatography (GPC). Specifically, an HLC-8120 manufactured by Tosoh Corporation is used for GPC, a TSKgel Super HM-M column (15 cm) manufactured by Tosoh Corporation is used, and a THF solvent is used for measurement of the polyester resin. Next, the molecular weight of the polyester resin is calculated using a molecular weight calibration curve created using monodisperse polystyrene standard samples.

Method of Manufacturing Polyester Resin

The method of manufacturing the polyester resin is not particularly limited, and the polyester resin is manufactured by a common polyester polymerization method in which an acid component and an alcohol component are reacted with each other. For example, the polyester resin is manufactured by properly using direct polycondensation, an ester interchange method, or the like depending on the types of monomers. The molar ratio (acid component/alcohol component) in the reaction between the acid component and the alcohol component varies according to the reaction conditions and the like, and thus may not be categorically defined. However, in general, in order to achieve a high molecular weight, the molar ratio is preferably about 1/1.

Examples of a catalyst that may be used in the manufacturing of the polyester resin include compounds of alkali metals such as sodium and lithium; compounds of alkaline earth metals such as magnesium and calcium; compounds of metals such as zinc, manganese, antimony, titanium, tin, zirconium, and germanium; phosphite compounds; phosphate compounds; and amine compounds.

Colorant

The colorant of the toner particles (a) is not particularly limited if it is a known colorant. Examples thereof include carbon blacks such as furnace black, channel black, acetylene black, and thermal black, inorganic pigments such as red iron oxide, Prussian blue, and titanium oxide, azo pigments such as fast yellow, disazo yellow, pyrazolone red, chelate red, brilliant carmine, and para brown, phthalocyanine pigments such as copper phthalocyanine and metal-free phthalocyanine, and condensed polycyclic pigments such as flavanthrone yellow, dibromoanthrone orange, perylene red, quinacridone red, and dioxazine violet.

In addition, as the colorant of the toner particles (a), a colorant having brilliance, that is, a bright pigment may be used.

Examples of the bright pigment include metallic powders such as aluminum, brass, bronze, nickel, stainless steel, and zinc, coated flake-like inorganic crystalline matrices of mica, barium sulfate, lamellar silicate, and silicate of lamellar aluminum coated with titanium oxide or yellow iron oxide, monocrystalline plate-like titanium oxide, basic carbonate, acidic bismuth oxychloride, natural guanine, flake-like glass powder, and metal-deposited flake-like glass powder. The bright pigment is not particularly limited if it is bright.

Here, "bright" in this exemplary embodiment means that an image formed with a toner containing a bright pigment has gloss such as metallic gloss.

Since the above-described bright pigment is flake-like and flat, the toner particles (a) containing the bright pigment are also flat. Therefore, when such a bright pigment is used, toner particles (a) satisfying the numerical value range of the above-described ratio (C/D) are easily obtained.

The content of colorants (excluding the bright pigment) in the toner particles (a) is preferably from 1 part by weight to 50 parts by weight with respect to 100 parts by weight of the toner, and more preferably from 3 parts by weight to 30 parts by weight.

In addition, when the colorant is a bright pigment, the content of the bright pigment is preferably from 1 part by weight to 70 parts by weight with respect to 100 parts by weight of the toner, and more preferably from 5 parts by weight to 50 parts by weight.

Release Agent

Examples of a release agent that is used in the toner particles (a) include paraffin wax such as low-molecular weight polypropylene and low-molecular weight polyethylene; silicone resins; rosins; rice wax; and carnauba wax. The melting temperature of the release agent is preferably from 50° C. to 100° C., and more preferably from 60° C. to 95° C.

The content of the release agent in the toner particles (a) is preferably from 0.5% by weight to 15% by weight, and more preferably from 1.0% by weight to 12% by weight.

Other Additives

Besides the components described above, various components such as a charge-controlling agent, an inorganic powder (inorganic particles), and organic particles may also be incorporated into the toner particles (a) as an internal additive if necessary.

Examples of a charge-controlling agent include quaternary ammonium salt compounds, nigrosine compounds, dyes composed of a complex of aluminum, iron, chromium and the like, and triphenylmethane pigments.

As inorganic particles, known inorganic particles such as silica particles, titanium oxide particles, alumina particles, cerium oxide particles, and particles obtained by hydrophobizing the surfaces of the above particles may be used singly or in a combination of two or more types. Among them, silica particles, that have a refractive index lower than that of the above-described binder resin, are preferably used. In addition, silica particles may be subjected to various surface treatments. For example, silica particles surface-treated with a silane-based coupling agent, a titanium-based coupling agent, a silicone oil, or the like are preferably used.

Characteristics of Toner Particles (a)

Volume Average Particle Diameter of Toner Particles (a)

The volume average particle diameter of the toner particles (a) is preferably from 1 μm to 30 μm, more preferably from 3 μm to 20 μm, and even more preferably from 5 μm to 10 μm.

The volume average particle diameter $D_{50}$ is obtained as follows.

A cumulative distribution is drawn from the smallest diameter side for the respective volume and number in the particle size ranges (channels) divided on the basis of a particle size distribution measured by a measuring machine such as a Multisizer II (manufactured by Beckman Coulter Inc.). The particle diameter corresponding to 16% in the cumulative distribution is defined as a volume $D_{16v}$ and a number $D_{16p}$, the particle diameter corresponding to 50% in the cumulative distribution is defined as a volume $D_{50v}$ and a number $D_{50p}$, and the particle diameter corresponding to 84% in the cumulative distribution is defined as a volume $D_{84v}$ and a number $D_{84p}$. The volume $D_{50v}$ is defined as a volume average particle diameter $D_{50}$.

Angle Between Long-Axis Direction of Cross-Section of Toner Particles (a) and Long-Axis Direction of Pigment Particles In addition, when the toner particles (a) contain a bright pigment as a colorant, the toner particles (a) preferably have the following characteristics.

That is, when observing a cross-section of the toner particles (a) in a thickness direction, the ratio (number-basis) of pigment particles in which an angle between a long-axis direction of the cross-section and a long-axis direction of the pigment particles satisfies the range of from −30° to +30° is preferably 60% or greater of all observed pigment particles. The ratio is more preferably from 70% to 95%, and particularly preferably from 80% to 90%.

When the ratio is 60% or greater in the toner particles, it is thought that surfaces in which the area of the bright pigment is maximum are arranged so as to face the surface of a recording medium in image formation. That is, in an image formed in this manner, the bright pigment is efficiently disposed, and excellent brilliance is thus obtained.

In addition, when an image formed in this manner is irradiated with light, the ratio of pigment particles that diffusely reflect incident light is suppressed. Accordingly, it is thought that a preferable range of a ratio (A/B) to be described later is achieved by using toner particles in which the above ratio is 60% or greater.

Here, a method of observing a cross-section of the toner particles (a) will be described.

First, the toner particles (a) are embedded using a bisphenol A-type liquid epoxy resin and a curing agent, and then a cutting sample is prepared. Next, the cutting sample is cut at −100° C. by the use of a cutter using a diamond knife, for example, LEICA ultra-microtome (manufactured by Hitachi High-Technologies Corporation) to prepare an observation sample.

Using the obtained observation sample, the cross sections of the toner particles are observed by a transmission electron microscope (TEM) at a magnification of about 5,000 times. In 1,000 toner particles observed, the number of pigment particles in which the angle formed between the long-axis direction of the cross-section of the toner and the long-axis direction of the pigment particles is from −30° to +30° is counted by the use of an image analysis software program and the ratio is calculated.

"Long-axis direction of a cross-section of the toner particles (a)" means a direction perpendicular to the thickness direction of toner particles of which the average equivalent circle diameter D is greater than the average maximum thickness C. "Long-axis direction of the pigment particles" means a length direction of the pigment particles.

Method of Manufacturing Toner Particles (a)

The toner particles (a) may be prepared through known methods such as wet manufacturing methods or dry manufacturing methods, but are particularly preferably manufactured through the use of wet manufacturing methods. Examples of wet manufacturing methods include a melt dispersion method, an emulsification and aggregation method, and a dissolution and suspension method, and an emulsification and aggregation method is preferably used for manufacturing.

In the emulsification and aggregation method, dispersions (resin particle dispersion and the like) in which respective materials of a toner are dispersed in an aqueous dispersion are prepared (emulsification process). Next, a raw material dispersion is prepared by mixing the resin particle dispersion and other various dispersions (colorant dispersion, release agent dispersion, and the like) that are used as necessary.

Next, toner particles are obtained through an aggregated particle forming process of forming aggregated particles in the raw material dispersion and a coalescence process of causing the aggregated particles to coalesce. When a so-called core-shell structure-type toner is prepared that has core particles and shell layers coating the core particles, a coating layer forming process is carried out to add a resin particle dispersion to the raw material dispersion after the aggregated particle forming process and to adhere resin particles to the surfaces of the aggregated particles (to be core particles in conversion into a toner), thereby forming a coating layer (to be a shell layer in conversion into a toner). Then, the coalescence process is carried out. The resin component that is used in the coating layer forming process may be the same as or different from the resin component of the core particles.

Hereinafter, the processes will be described in detail.

Emulsification Process

In order to prepare a raw material dispersion that is used in the aggregated particle forming process, emulsion dispersions in which major materials of a toner are dispersed in an aqueous medium are prepared in the emulsification process. Hereinafter, a resin particle dispersion, a colorant dispersion, and a release agent dispersion will be described.

Resin Particle Dispersion

The volume average particle diameter of the resin particles that are dispersed in the resin particle dispersion is preferably from 0.01 μm to 1 μm, more preferably from 0.03 μm to 0.8 μm, and even more preferably from 0.03 μm to 0.6 μm.

When the volume average particle diameter of the resin particles is greater than 1 μm, the particle diameter distribution of a finally obtained toner widens, or free particles are generated, whereby performance and reliability are easily reduced in some cases. On the other hand, since the above-described flaws are not caused, unevenness in component distribution between the toner particles is reduced, the resin particles are dispersed well in the toner particles, and variation in performance and reliability is reduced, it is beneficial that the volume average particle diameter is in the above range.

The volume average particle diameter of the particles such as resin particles that are contained in the raw material dispersion is measured using a laser diffraction particle size distribution measuring apparatus (manufactured by Horiba Ltd., LA-700).

The dispersion medium that is used in the resin particle dispersion and other dispersions may be an aqueous medium.

Examples of the aqueous medium include water such as distilled water and ion-exchange water and alcohols. These may be used singly or in a combination of two or more types. In this exemplary embodiment, a surfactant may be added to and mixed with the aqueous medium.

The surfactant is not particularly limited, and examples thereof include anionic surfactants such as sulfate, sulfonate, phosphate, and soap surfactants; cationic surfactants such as amine salt and quaternary ammonium salt surfactants; and nonionic surfactants such as polyethylene glycol, alkylphenol ethylene oxide adducts, and polyol surfactants. Among them, anionic surfactants and cationic surfactants may be used. The nonionic surfactants may be used in combination with the anionic surfactants or cationic surfactants. The surfactants may be used singly or in a combination of two or more types.

Specific examples of the anionic surfactants include sodium dodecylbenzene sulfonate, sodium dodecyl sulfate, sodium alkyl naphthalene sulfonate, and dialkyl sodium sulfosuccinate. In addition, specific examples of the cationic surfactants include alkylbenzene dimethyl ammonium chloride, alkyl trimethyl ammonium chloride, and distearyl ammonium chloride. Among them, ionic surfactants such as anionic surfactants and cationic surfactants may be used.

Since a polyester resin contains a functional group that may be an anionic type due to neutralization, the polyester resin has self-dispersibility in water, and forms a water dispersion stabilized under the action of an aqueous medium, in which some or all of functional groups that may have hydrophilicity are neutralized by a base.

The functional group that may be a hydrophilic group due to neutralization in the polyester resin is an acid group such as a carboxyl group or a sulfonate group. Therefore, examples of a neutralizer include inorganic alkalis such as potassium hydroxide and sodium hydroxide, and amines such as ammonia, monomethylamine, dimethylamine, triethylamine, monoethylamine, diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, N,N-dimethylpropanolamine. At least one, or two or more types of the above may be selected and used. The pH in emulsification is adjusted to be neutral by adding the neutralizers, thereby preventing hydrolysis of the obtained polyester resin dispersion.

When the resin particle dispersion is prepared using a polyester resin, a phase inversion emulsification method may be used. The phase inversion emulsification method may also be used when the resin particle dispersion is prepared using a binder resin other than a polyester resin. In the phase inversion emulsification method, a resin to be dispersed is dissolved in a hydrophobic organic solvent in which the resin is soluble, and a base is added to an organic continuous phase (O-phase) to carry out neutralization. Then, an aqueous medium (W-phase) is added, and thus conversion (so-called phase inversion) of the resin from W/O to O/W occurs to form a discontinuous phase, whereby the resin is stably dispersed in the aqueous medium in a particulate form.

Examples of an organic solvent that is used in the phase inversion emulsification include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol, ketones such as methyl ethyl ketone, methyl isobutyl ketone, ethyl butyl ketone, cyclohexanone and isophorone, ethers such as tetrahydrofuran, dimethyl ether, diethyl ether and dioxane, esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate and dimethyl carbonate, glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether, 3-methoxy-3-methylbutanol, 3-methoxybutanol, acetonitrile, dimethyl formamide, dimethyl acetamide, diacetone alcohol, and ethyl acetoacetate. The solvents may be used singly or in a combination of two or more types.

Regarding the amount of an inorganic solvent that is used in the phase inversion emulsification, the amount of a solvent for obtaining a desired dispersed particle diameter varies with the physical properties of the resin, and thus in general, it is difficult to determine the amount of a solvent. However, in this exemplary embodiment, when the content of a tin compound catalyst in the resin is greater than in the cases of common polyester resins, the amount of the solvent with respect to the weight of the resin may be relatively large. When the amount of the solvent is small, the emulsifying property is deteriorated, and thus in some cases, the particle diameter of the resin particles increases or the particle size distribution broadens.

In addition, a dispersant may be added for the purpose of stabilizing the dispersed particles and preventing an increase in viscosity of the aqueous medium in the phase inversion emulsification. Examples of a dispersant include water-soluble polymers such as polyvinyl alcohol, methyl cellulose, ethyl cellulose, hydroxyethyl cellulose, carboxymethyl cellulose, sodium polyacrylate and sodium polymethacrylate, and inorganic compounds such as tricalcium phosphate, aluminum hydroxide, calcium sulfate, calcium carbonate and barium carbonate. The dispersants may be used singly or in a combination of two or more types. The dispersant may be added in an amount of from 0.01 part by weight to 20 parts by weight with respect to 100 parts by weight of the binder resin.

The emulsification temperature in the phase inversion emulsification may be equal to or lower than the boiling point of the organic solvent, and equal to or higher than the melting temperature or the glass transition temperature of the binder resin. When the emulsification temperature is lower than the melting temperature or the glass transition temperature of the binder resin, it is difficult to prepare the resin particle dispersion. When the emulsification is performed at a temperature equal to or higher than the boiling point of the organic solvent, the emulsification may be performed in a pressurized and sealed device.

Generally, the content of resin particles that are contained in the resin particle dispersion is preferably from 5% by weight to 50% by weight, and more preferably from 10% by weight to 40% by weight. When the content is outside the above range, the particle size distribution of the resin particles widens, and the characteristics deteriorate in some cases.

Colorant Dispersion

Examples of a dispersing method to prepare a colorant dispersion include, but are not limited to, general dispersing methods using a rotation shearing homogenizer, a ball mill having a media, a sand mill, and a DYNO mill. If necessary, an aqueous dispersion of a colorant may be prepared by the use of a surfactant, or an organic solvent dispersion of a colorant may be prepared by the use of a dispersant. The surfactant or the dispersant that is used in the dispersion may be the same as a dispersant that may be used in the dispersion of the binder resin.

In addition, in the preparation of the raw material dispersion, the colorant dispersion may be mixed together with a dispersion in which other particles are dispersed in one stage, or may be added and mixed in divided multiple stages.

Generally, the content of the colorant that is contained in the colorant dispersion is preferably from 5% by weight to 50% by weight, and more preferably from 10% by weight to 40% by weight. In some cases, when the content is outside the above range, the particle size distribution of the colorant particles widens, and the characteristics deteriorate.

Release Agent Dispersion

A release agent dispersion is prepared through processes of dispersing a release agent in water together with an ionic surfactant and the like, heating to a temperature equal to or higher than a melting temperature of the release agent, and applying a strong shearing force by using a homogenizer or a pressure discharging dispersing machine. In this manner, release agent particles having a volume average particle diameter of 1 μm or less are dispersed. In addition, the dispersion medium in the release agent dispersion may be the same as that which is used for the binder resin.

Known devices may be used as a device for mixing a binder resin, a colorant, and the like with a dispersion medium and performing emulsification and dispersion, and examples thereof include continuous emulsification-dispersing machines such as HOMO Mixer (Tokushu Kika Kogyo KK.), Slasher (Mitsui Mining Co., Ltd.), Cavitron (Eurotec Co., Ltd.), Microfluidizer (Mizuho Industrial Co., Ltd.), Manton-Gaulin Homogenizer (Manton Gaulin Mfg. Co., Inc.), Nanomizer (Nanomizer Inc.), and Static Mixer (Noritake CO., Ltd).

Depending on the purpose, the above-described release agent and internal additives (components such as a charge-controlling agent and an inorganic powder) may be dispersed in the binder resin dispersion liquid.

In addition, when a dispersion of a component other than the binder resin, the colorant and the release agent is prepared, the volume average particle diameter of particles that are dispersed in the dispersion may be generally 1 μm or less, and preferably from 0.01 μm to 0.5 μm. When the volume average particle diameter is greater than 1 μm, the particle diameter distribution of a finally obtained toner widens, or free particles are generated, whereby performance and reliability are easily reduced in some cases. On the other hand, since the above-described flaws are not caused, unevenness in distribution between the toner particles is reduced, the component is dispersed well in the toner particles, and variation in performance and reliability is reduced, it is beneficial that the volume average particle diameter is in the above range.

Aggregated Particle Forming Process

In the aggregated particle forming process (aggregated particle dispersion preparation process), an aggregating agent is further added to the raw material dispersion that is generally obtained by adding the colorant dispersion and the release agent dispersion as well as the resin particle dispersion liquid and by at least mixing other dispersions added as necessary therewith, and the mixture is heated to aggregate the particles to thereby form aggregated particles. When the resin particles are a crystalline resin such as crystalline polyester, the heating is performed at a temperature that is near a melting temperature (±20° C.) of the crystalline resin and is equal to or lower than the melting temperature. The particles are aggregated and aggregated particles are formed.

The aggregated particles are formed by adding an aggregating agent at room temperature during stirring using a rotation shearing homogenizer and by making the pH of the raw material dispersion acidic. In addition, in order to suppress rapid aggregation due to the heating, the pH may be adjusted during the stirring and mixing at room temperature, and if necessary, a dispersion stabilizer may be added.

In this exemplary embodiment, "room temperature" means 25° C.

Examples of an aggregating agent that is used in the aggregated particle forming process include surfactants having a polarity opposite to that of the surfactant used as a dispersant added to the raw material dispersion. That is, inorganic metallic salts and di- or higher-valent metallic complexes are preferably used. Particularly, when a metallic complex is used, the amount of the surfactant used may be reduced, and charging characteristics are improved.

If necessary, an additive may be used to form a complex or a similar bond with metallic ions of the aggregating agent. A chelating agent is preferably used as the additive.

Here, examples of inorganic metallic salts include metallic salts such as calcium chloride, calcium nitrate, barium chloride, magnesium chloride, zinc chloride, aluminum chloride and aluminum sulfate; inorganic metallic salt polymers such as polyaluminum chloride, polyaluminum hydroxide and calcium polysulfide. Among them, aluminum salts and polymers thereof are preferably used. In order to obtain a narrower particle size distribution, the valence of the inorganic metallic salt is preferably greater, i.e., divalent is more suitable than monovalent, trivalent is more suitable than divalent, and tetravalent is more suitable than trivalent, and in the case of the same valence number, a polymer-type inorganic metallic salt polymer is more preferably used.

Water-soluble chelating agents may be used as the chelating agent. In the case of water-insoluble chelating agents, the dispersibility in the raw material dispersion is poor and the capture of the metallic ions resulting from the aggregating agent in the toner is not sufficiently carried out in some cases.

The chelating agent is not particularly limited if it is a known water-soluble chelating agent. For example, oxycarboxylic acids such as tartaric acid, citric acid and gluconic acid, iminodiacetic acids (IDA), nitrilotriacetic acids (NTA), and ethylenediamine tetraacetic acids (EDTA) may be preferably used.

The amount of the chelating agent added is preferably from 0.01 part by weight to 5.0 parts by weight with respect to 100 parts by weight of the binder resin, and more preferably from 0.1 part by weight to less than 3.0 parts by weight. When the amount of the chelating agent added is less than 0.01 part by weight, the effect of the addition of the chelating agent is not exhibited in some cases. On the other hand, when the amount of the chelating agent added is greater than 5.0 parts by weight, the electrostatic property is adversely affected and the viscoelasticity of the toner dramatically changes, whereby the low-temperature fixability and the image gloss property are adversely affected in some cases.

The chelating agent is added during, before or after the aggregated particle forming process or the coating layer forming process. When the chelating agent is added, it is not necessary to control the temperature of the raw material dispersion. The chelating agent may be added at room temperature, or may be added after adjusting to the temperature in a tank in the aggregated particle forming process or the coating layer forming process.

Coating Layer Forming Process

After the aggregated particle forming process, the coating layer forming process may be performed, if necessary. In the coating layer forming process, resin particles for forming a coating layer are adhered to the surfaces of the aggregated particles formed through the above-described aggregated particle forming process, thereby forming a coating layer. In this manner, a toner having a so-called core-shell structure is obtained.

Generally, the coating layer is formed by further adding a resin particle dispersion to the raw material dispersion containing the aggregated particles (core particles) formed in the aggregated particle forming process.

The coalescence process is performed after the coating layer forming process. The coating layer may be formed in multiple stages by alternately repeating the coating layer forming process and the coalescence process.

Coalescence Process

In the coalescence process that is performed after the aggregated particle forming process, or after the aggregated particle forming process and the coating layer forming process, the progress of the aggregation is stopped by adjusting the pH of the suspension containing the aggregated particles formed through the above processes to from about 6.5 to about 8.5.

After the progress of the aggregation is stopped, coalescence of the aggregated particles is caused by heating. The coalescence of the aggregated particles may be performed by heating at a temperature equal to or higher than the melting temperature of the binder resin.

Washing and Drying Processes and the Like

After the aggregated particle coalescence process, desired toner particles are obtained through a washing process, a solid liquid separation process, and a drying process. In the washing process, it is desirable that after the dispersant attached onto the toner particles is removed with an aqueous solution of a strong acid such as hydrochloric acid, sulfuric acid or nitric acid, the toner particles are washed with ion-exchange water or the like until the pH of the filtrate is neutral. In addition, the solid-liquid separation process is not particularly limited, and suction filtration, pressure filtration, and the like are preferably performed from the viewpoint of productivity. Furthermore, the drying process is not particularly limited, and freeze drying, flush jet drying, fluidized drying, vibrating fluidized drying and the like are performed from the viewpoint of productivity.

In the drying process, the water content of the toner particles after drying is preferably adjusted to 1.0% by weight or less, and more preferably adjusted to 0.5% by weight or less.

When the toner particles (a) containing a bright pigment as a colorant are manufactured by the emulsification and aggregation method, the toner particles (a) are preferably prepared using, for example, the following manufacturing method.

First, pigment particles are prepared, and the pigment particles and a binder resin are dispersed and dissolved in a solvent to be mixed with each other. The mixture is dispersed in water by phase inversion emulsification or shearing emulsification to form bright pigment particles covered with the resin. Other compositions (for example, release agent, resin for a shell, and the like) are added thereto, and an aggregating agent is further added thereto. While the materials are stirred, the temperature is raised to near the glass transition temperature (Tg) of the resin to form aggregated particles. In this process, for example, using a stirring blade having two paddles that forms a laminar flow, the stirring is performed at a stirring rate set to be high (for example, from 500 rpm to 1500 rpm) so that the bright pigment particles are aligned in the long-axis direction in the aggregated particles, and the aggregated particles are also aggregated in the long-axis direction, whereby the thickness of the toner is reduced. Finally, alkalization is carried out for stabilization of the particles, and then the temperature is raised to be equal to or higher than the glass transition temperature (Tg) of the toner and equal to or lower than the melting temperature (Tm) to cause the aggregated particles to coalesce. In this coalescence process, by performing the coalescence at a lower temperature (for example, from 60° C. to 80° C.), the movement with rearrangement of the materials is reduced, and toner particles in which the orientation of the pigment is maintained are obtained.

Using the above method, toner particles designed to obtain an image having excellent brilliance are obtained.

The stirring rate is preferably from 650 rpm to 1130 rpm, and particularly preferably from 760 rpm to 870 rpm. In addition, the coalescence temperature in the coalescence process is preferably from 63° C. to 75° C., and particularly preferably from 65° C. to 70° C.

Inorganic Particles (b)

The inorganic particles (b) of this exemplary embodiment are silicone oil-treated inorganic particles in which the amount of free silicone oil with respect to the inorganic particles is from 0.1% by weight to 5% by weight.

Generally, when inorganic particles are treated with a silicone oil, the silicone oil is classified into two types of silicone oil, that is, silicone oil that adheres to the surfaces of the inorganic particles and silicone oil free from the inorganic particles. The latter silicone oil is referred to as free silicone oil, and in the case of the inorganic particles (b), the amount of free silicone oil is in the above range.

In addition, the inorganic particles (b) are silicon oil-treated inorganic particles in which the amount of free silicone oil is from 0.1% by weight to 10% by weight.

The amount of free silicone oil is preferably from 0.1% by weight to 5% by weight with respect to inorganic particles before treatment, more preferably from 0.3% by weight to 3% by weight, and even more preferably from 0.5% by weight to 2% by weight.

Free Silicone Oil Amount Measurement Method

Hereinafter, a method of obtaining the amount of free silicone oil of the inorganic particles (b) that are an external additive from the toner according to this exemplary embodiment will be shown. However, the amount of free silicone oil may also be obtained from the inorganic particles (b) that are an external additive.

2 g of a toner is added to 40 ml of an aqueous solution of a 0.2% by weight surfactant (polyoxyethylene (10) octylphenyl ether with a polyoxyethylene polymerization degree of 10, manufactured by Wako Pure Chemical Industries, Ltd.), and sufficiently dispersed so as to disperse the toner. In this state, an ultrasonic vibration having an output of 20 W and a frequency of 20 kHz is applied for 1 minute using an ultrasonic homogenizer US300T (manufactured by Nissei Corporation) to desorb external additive particles.

Thereafter, the dispersion is put into a sedimentation tube-attached centrifugal of 50 ml (small-size cooled fast centrifugal M160 IV, manufactured by Sakuma Seisakusho) to separate the toner at 3,000 rpm for 7 minutes, and the supernatant liquid is removed using a 5 μm-membrane filter (Millipore Corporation, FHLP 02500). Then, further removal is carried out using a 0.22 μm-membrane filter (GSEP 047S0) and a 0.025 μm-membrane filter (VSWP 02500), and then the filtrate is dried. When a sample amount necessary for the measurement may not be recovered, the same operation is repeated until a sample amount necessary for the measurement may be recovered. The NMR measurement is performed using 10 mg of the dried residue.

Using AL-400 (magnetic field 9.4 T (H-nucleus 400 MHz)) manufactured by JEOL Ltd., proton NMR measurement is performed. A sample tube (diameter 5 mm) made of zirconia is filled with a sample, a deuterochloroform solvent, and TMS as a primary standard. The sample tube is set and measurement is performed at, for example, a frequency of Δ87 kHz/400 MHz (=Δ20 ppm), a measurement temperature of 25° C., cumulative number of 16, and a resolution of 0.24 Hz (about 32,000 point). The peak intensity derived from the free surface treatment agent is converted into a free surface treatment agent amount by the use of a calibration curve.

For example, when a dimethyl silicone oil is used as a free surface treatment agent, NMR measurement of an untreated external additive base material and the dimethyl silicone oil (an amount of approximately level 5 is shaken) is performed to create a calibration curve of a free surface treatment agent amount and an NMR peak intensity.

Inorganic Particles

Inorganic particles corresponding to cores in the inorganic particles (b) are treated with a silicone oil, and are not particularly limited if the amount of the organic silicone oil may be adjusted to the above range. Silica particles, titanium oxide particles, alumina particles, cerium oxide particles, carbon black, or the like are used.

Among them, silica particles are preferably used from the viewpoint of application of electric charges to the outermost surfaces of the toner particles, application of fluidity, and affinity with the silicone oil (holding stability).

As silica particles corresponding to cores in the inorganic particles (b), silica particles manufactured by known methods such as a sol-gel method that is a wet production method, and commercially available silica particles may be applied.

Silicone Oil

As the silicone oil for the surface treatment on the above-described inorganic particles, known silicone oils are applied.

Examples of silicone oil include a dimethyl silicone oil, an alkyl-modified silicone oil, an amino-modified silicone oil, a carboxylic acid-modified silicone oil, an epoxy-modified silicone oil, a fluorine-modified silicone oil, an alcohol-modified silicone oil, a polyether-modified silicon oil, a methylphenyl silicone oil, a methyl hydrogen silicone oil, a mercapto-modified silicone oil, a higher fatty acid-modified silicone oil, a phenol-modified silicone oil, a methacrylic acid-modified silicone oil, and a methylstyryl-modified silicone oil.

As the silicone oil used in the surface treatment, only one type may be used, or two or more types may be used in combination.

Method of Manufacturing Inorganic Particles (b)

The silicone-oil-treated inorganic particles in which the amount of free silicone oil is in the above range are manufactured as follows.

Examples of a method of treating inorganic particles with a silicone oil include dry production methods such as a spray-dry method of spraying a silicone oil or a solution containing a silicone oil to inorganic particles made to float in a vapor phase, and wet production methods of dipping inorganic particles in a treatment agent (solution) containing a silicone oil and drying the solvent.

After the surface treatment is performed using the above method, the inorganic particles are dipped again in a solvent such as ethanol, and the solvent is dried to remove the silicone oil excessively applied, whereby the inorganic particles (b) are manufactured.

In order to reduce the amount of free silicone oil, the above-described process of dipping the inorganic particles in the solvent and drying the solvent may be repeatedly executed.

From the viewpoint of long-term stabilization in electrostatic property, the amount of the silicone oil applied to the inorganic particles (b) is preferably from 1.0% by weight to 30% by weight with respect to the weight of the inorganic particles corresponding to cores, more preferably from 2.0% by weight to 25% by weight, and even more preferably from 3.0% by weight to 20% by weight.

The amount of the silicone oil applied to the inorganic particles (b) is not an amount of the silicone oil actually applied to the inorganic particles, but an amount of the silicone oil used for the inorganic particles that are cores in the surface treatment.

Characteristics of Inorganic Particles (b)

Average Primary Particle Diameter of Inorganic Particles (b)

The average primary particle diameter of the inorganic particles (b) is preferably from 30 nm to 200 nm, more preferably from 40 nm to 180 nm, and even more preferably from 50 nm to 150 nm.

When the average primary particle diameter of the inorganic particles (b) is 30 nm or greater, the inorganic particles (b) may not be embedded in concave portions, and may uniformly adhere to the toner particles without being aggregated, and good fluidity and a good electrostatic property may be applied. When the average primary particle diameter is 200 nm or less, the inorganic particles (b) stably adhere to the surfaces of the toner particles without being separated from convex portions of the toner. Since the inorganic particles have an appropriate size, even when the inorganic particles move to concave portions, functions may be maintained so that, for example, good fluidity is maintained over a long period of time.

The average primary particle diameter of the inorganic particles (b) is obtained by measuring primary particle diameters from a scanning electron microscope photograph and calculating an average value thereof.

Toner Manufacturing Method

The toner according to this exemplary embodiment are obtained by manufacturing the toner particles (a) and the inorganic particles (b) as described above and then by externally adding the inorganic particles (b) to the toner particles (a).

Examples of a method of externally adding the inorganic particles (b) to the toner particles (a) include mixing by known mixers such as a V-blender, a Henschel mixer, and a Loedige mixer.

In the toner according to this exemplary embodiment, the amount of the inorganic particles (b) added with respect to 100 parts by weight of the toner particles (a) is from 0.1 part by weight to 10 parts by weight, preferably from 0.3 part by weight to 7.0 parts by weight, and more preferably from 0.5 part by weight to 5.0 parts by weight.

When the amount of the inorganic particles (b) added with respect to the toner particles (a) is in the above range, the inorganic particles (b) are effectively added to the toner particles (a), and partial wear and scratches may be suppressed from being caused on the cleaning blade.

When the amount added is less than 0.1 part by weight, the fluidity that is applied to the toner is reduced, the torque of a blade nip increases, and the blade partially wears easily. Furthermore, since the fluidity of the toner deteriorates, the toner adheres in the machine, there is a deterioration in transport in the developing machine, clogging occurs in the toner recovery path, and thus it is not preferable that the amount added is less than 0.1 part by weight. When the amount added is greater than 10 parts by weight, separation from toner base particles easily occurs, and thus the surface of a photoreceptor, a developing member, and the like are contaminated. In addition, the potential varies, and thus images are not stably formed, and deletion, unevenness in density, and the like are easily caused.

Characteristics of Toner

In the toner according to this exemplary embodiment, it is desirable that when a solid image is formed, a ratio (A/B) of reflectance A at an acceptance angle of +30° that is measured when the solid image is irradiated with incident light at an incidence angle of −45° by the use of a variable-angle photometer to reflectance B at an acceptance angle of −30° is from 2 to 100.

The ratio (A/B) that is 2 or greater means that a larger amount of light is reflected to the opposite side (angle+side) of a side on which the incident light is incident than to the side on which the incident light is incident (angle−side), that is, means that the diffused reflection of the incident light is suppressed. When diffused reflection in which the incident light is reflected in various directions occurs, the color is dulled when visually perceiving the reflected light. Therefore, when the ratio (A/B) is 2 or greater, gloss is perceived if the reflected light is visually perceived, and brilliance is excellent.

On the other hand, when the ratio (A/B) is 100 or less, the viewing angle at which the reflected light may be visually perceived is not excessively narrowed and a phenomenon in which the reflected light looks dark depending on the angle is prevented from occurring.

The ratio (A/B) is more preferably from 20 to 90, and particularly preferably from 40 to 80.

Measurement of Ratio (A/B) Using Variable-Angle Photometer

Here, first, the incidence angle and the acceptance angle will be described. In this exemplary embodiment, the incidence angle is set to −45° at the time of measurement using the variable-angle photometer. This is because the measuring sensitivity is high for an image having a wide gloss range.

The acceptance angle is set to −30° and +30°, because the measuring sensitivity at the angles is the highest in evaluating a bright image and a non-bright image.

Next, a method of measuring the ratio (A/B) will be described.

In this exemplary embodiment, a "solid image" is first formed through the following method when measuring the ratio (A/B). A developing machine of DocuCentre-III C7600, manufactured by Fuji Xerox Co, ltd., is filled with a developer as a sample, and a solid image in which the amount of the toner is 4.5 g/m$^2$ is formed on a recording sheet (an OK top-coated+sheet of paper, manufactured by Oji Paper Co., Ltd.) at a fixing temperature of 190° C. with a fixing pressure of 4.0 kg/cm$^2$. "Solid image" means an image with a printing rate of 100%.

The image part of the formed solid image is irradiated with incident light at an incidence angle of −45° on the solid image using a spectroscopic deflection color-difference meter GC5000L manufactured by Nippon Denshoku Industries Co., Ltd. as a variable-angle photometer, and reflectance A at an acceptance angle of +30° and reflectance B at an acceptance angle of −30° are measured. Reflectance A and reflectance B are measured at intervals of 20 nm using light in the wavelength range of from 400 nm to 700 nm and the average reflectance at the wavelengths is calculated. The ratio (A/B) is calculated from these measurement results.

Developer (Electrostatic Latent Image Developer)

A developer according to this exemplary embodiment contains at least the electrostatic latent image developing toner according to this exemplary embodiment.

The electrostatic latent image developing toner according to this exemplary embodiment may be used as a single-component developer as it is, or may be used as a two-component developer by mixing with a carrier.

The carrier that may be used in a two-component developer is not particularly limited, and known carriers may be used. Examples thereof include magnetic metals such as iron oxide, nickel, and cobalt, magnetic oxides such as ferrite and magnetite, resin-coated carriers having a resin coating layer on surfaces of the cores, and magnetism dispersion-type carriers. In addition, resin dispersion-type carriers in which a conductive material and the like are dispersed in a matrix resin may also be used.

Examples of a coating resin and a matrix resin that are used in the carrier include, but are not limited to, polyethylene, polypropylene, polystyrene, polyvinyl acetate, polyvinyl alcohol, polyvinyl butylal, polyvinyl chloride, polyvinyl ether, polyvinyl ketone, vinyl chloride-vinyl acetate copolymer, styrene-acrylic acid copolymer, a straight silicone resin having an organosiloxane bond and modified products thereof, a fluorine resin, polyester, polycarbonate, a phenolic resin, and an epoxy resin.

Examples of the conductive material include, but are not limited to, metals such as gold, silver, and copper, carbon black, titanium oxide, zinc oxide, barium sulfide, aluminum borate, potassium titanate, and tin oxide.

Examples of a core material of the carrier include magnetic metals such as iron, nickel, and cobalt, magnetic oxides such as ferrite and magnetite, and glass beads. Among them, magnetic materials are preferably used to use the carrier in a magnetic brush method. The volume average particle diameter of the core material of the carrier is generally from 10 μm to 500 μm, and preferably from 30 μm to 100 μm.

Examples of a method of coating the surface of the core material of the carrier with a resin include a method of performing coating using a coating layer forming solution in which the coating resin and various additives as necessary are dissolved in an appropriate solvent, and the like. The solvent is not particularly limited, and may be appropriately selected in consideration of the coating resin to be used, the application property, and the like.

Specific examples of a resin coating method include a dipping method of dipping the core material of the carrier in a coating layer forming solution, a spray method of spraying a coating layer forming solution to the surface of the core material of the carrier, a fluidized bed method of spraying a coating layer forming solution in a state in which the core material of the carrier is made to float by the use of an air flow, and a kneader-coater method of mixing the core material of the carrier with a coating layer forming solution in a kneader coater to remove the solvent.

The mixing ratio (weight ratio) of the electrostatic latent image developing toner according to this exemplary embodiment and the carrier in the two-component developer is preferably from 1:100 to 30:100 (toner:carrier), and more preferably from 3:100 to 20:100.

Image Forming Apparatus and Image Forming Method

FIG. 1 is a schematic diagram showing the configuration of an exemplary embodiment of an image forming apparatus including a developing device to which the electrostatic latent image developing toner according to this exemplary embodiment is applied.

In the drawing, the image forming apparatus of this exemplary embodiment has a photoreceptor drum 20 as an image holding member that rotates in a predetermined direction, and a charging device 21 that charges the photoreceptor drum 20, an exposing device 22 as a latent image forming device that forms an electrostatic latent image z on the photoreceptor drum 20, a developing device 30 that visualizes the electrostatic latent image Z formed on the photoreceptor drum 20, a transfer device 24 that transfers the visualized toner image on the photoreceptor drum 20 onto a recording sheet 28 as a recording medium, and a cleaning device 25 that cleans the toner remaining on the photoreceptor drum 20 are sequentially arranged around the photoreceptor drum 20.

In this exemplary embodiment, as shown in FIG. 1, the developing device 30 has a developing housing 31 accommodating a developer G including a toner 40. A developing opening 32 is formed in the developing housing 31 to be opposed to the photoreceptor drum 20, a developing roll (developing electrode) 33 as a toner holding member is disposed to face the developing opening 32, and a developing electric field is formed in a developing region of a region interposed between the photoreceptor drum 20 and the developing roll 33 by applying a predetermined developing bias to the developing roll 33. A charge injection roll (injection electrode) 34 as a charge injecting member is provided in the developing housing 31 to be opposed to the developing roll 33. Particularly, in this exemplary embodiment, the charge injection roll 34 is also used as a toner supply roll for supplying the toner 40 to the developing roll 33.

Here, the rotation direction of the charge injection roll 34 may be arbitrarily selected, but in consideration of the toner supply property and the charge injection characteristics, it is desirable that the charge injection roll 34 rotates in a part opposed to the developing roll 33 in the same direction and with a peripheral speed difference (for example, 1.5 multiples or more), the toner 40 is interposed between the charge injection roll 34 and the developing roll 33, and electric charges are injected by frictional contact.

The image forming method according to this exemplary embodiment is performed by the image forming apparatus according to this exemplary embodiment, and includes charging a surface of an image holding member; forming an electrostatic latent image on the surface of the image holding member; developing the electrostatic latent image with the electrostatic latent image developing toner according to this exemplary embodiment to form a toner image; transferring the developed toner image onto a recording medium; fixing the toner image transferred onto the recording medium; and cleaning with a cleaning blade that is brought into contact with the surface of the image holding member to clean the surface.

Next, an operation of the image forming apparatus according to this exemplary embodiment will be described.

When an image forming process is started, the surface of the photoreceptor drum 20 is first charged by the charging device 21. The exposing device 22 forms an electrostatic latent image z on the charged photoreceptor drum 20, and the developing device 30 visualizes the electrostatic latent image Z as a toner image. Thereafter, the toner image on the photoreceptor drum 20 is transported to a transfer site, and the transfer device 24 transfers the toner image on the photoreceptor drum 20 to a recording sheet 28 as a recording medium in an electrostatic manner. The toner remaining on the photoreceptor drum 20 is cleaned by the cleaning device 25 provided with a cleaning blade. Then, the toner image on the recording sheet 28 is fixed by a fixing device (not shown), whereby an image is obtained.

Process Cartridge and Toner Cartridge

Figure 2:
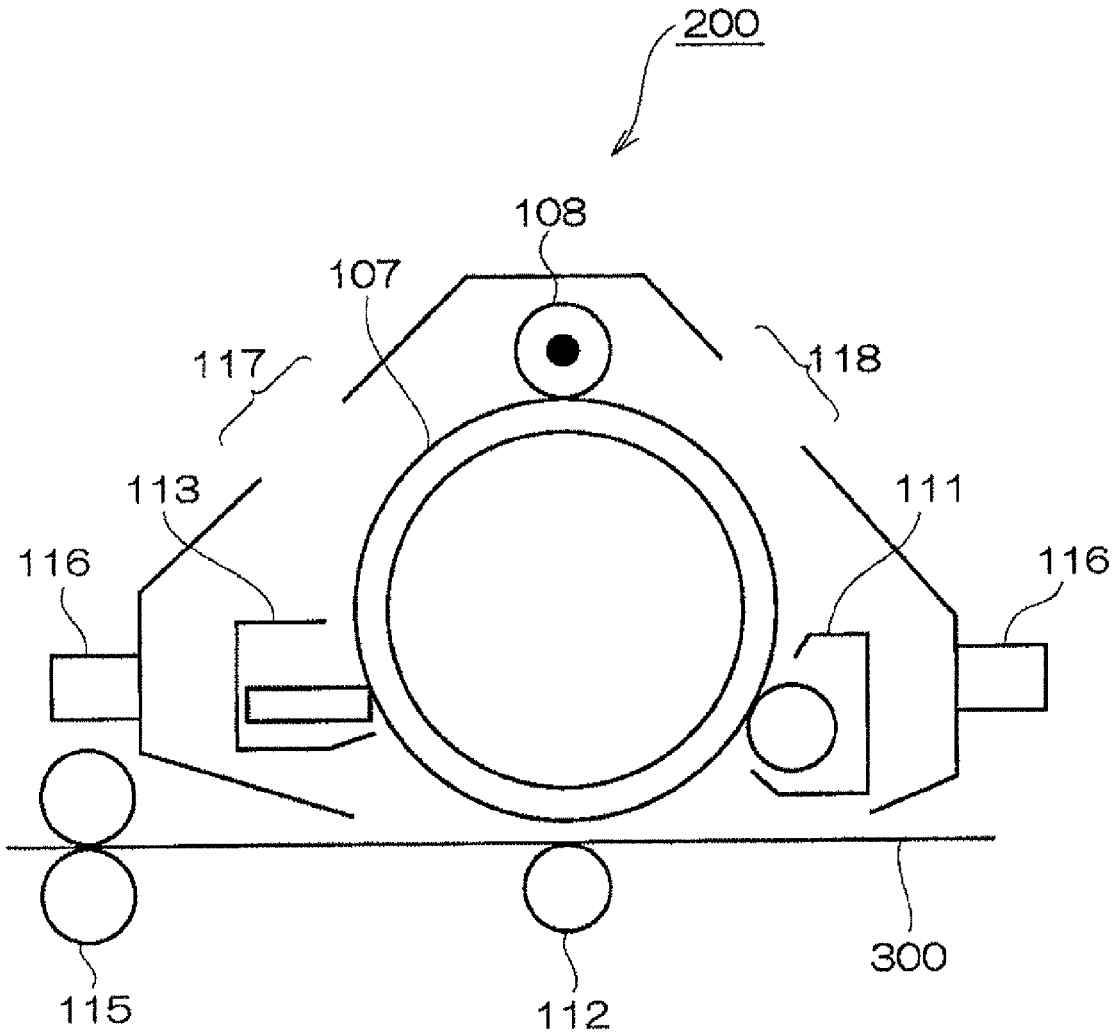
FIG. 2 is a schematic diagram showing the configuration of an example of a process cartridge of this exemplary embodiment.

FIG. 2 is a schematic diagram showing the configuration of an example of a process cartridge of this exemplary embodiment. The process cartridge of this exemplary embodiment accommodates the above-described electrostatic latent image developing toner according to this exemplary embodiment and is provided with a toner holding member holding and transporting the toner.

A process cartridge 200 shown in FIG. 2 has, in addition to a photoreceptor 107 as an image holding member, a charging device 108, a developing device 111 that accommodates the above-described electrostatic latent image developing toner according to this exemplary embodiment, a photoreceptor cleaning device 113, an exposure opening portion 118, and an opening portion for erasing exposure 117, that are combined and integrated using an attachment rail 116. The process cartridge 200 is detachably mounted on an image forming apparatus body including a transfer device 112, a fixing device 115, and other constituent portions (not shown), and forms the image forming apparatus along with the image forming apparatus body.

The reference numeral 300 in FIG. 2 represents a recording sheet that is a recording medium.

The process cartridge 200 shown in FIG. 2 is provided with the charging device 108, the developing device 111, the cleaning device 113, the exposure opening portion 118, and the opening portion for erasing exposure 117, but these devices may be selectively combined. The process cartridge of this exemplary embodiment is provided with at least one selected from the group consisting of the photoreceptor 107, the charging device 108, the cleaning device (cleaning section) 113, the exposure opening portion 118, and the opening portion for erasing exposure 117, as well as the developing device 111.

Next, a toner cartridge of this exemplary embodiment will be described. The toner cartridge of this exemplary embodiment is detachably mounted on the image forming apparatus, and at least, in the toner cartridge that accommodates a toner to be supplied to a developing section provided in the image forming apparatus, the toner is the above-described electrostatic latent image developing toner according to this exemplary embodiment. In the toner cartridge of this exemplary embodiment, at least a toner may be accommodated, and depending on the mechanism of the image forming apparatus, for example, a developer may be accommodated.

The image forming apparatus shown in FIG. 1 is an image forming apparatus that has a configuration in which a toner cartridge (not shown) is detachably mounted. The developing device 30 is connected to the toner cartridge through a toner supply tube (not shown). In addition, when the toner stored in the toner cartridge runs low, the toner cartridge may be replaced.

EXAMPLES

Hereinafter, this exemplary embodiment will be described in more detail with reference to examples and comparative examples, but is not limited to the following examples. "Parts" and "%" are based on the weight unless specifically noted.

Example 1

Synthesis of Binder Resin

Terephthalic Acid: 30 parts
Fumaric Acid: 70 parts
Bisphenol A Ethyleneoxide 2 mol Adduct: 40 parts
Bisphenol A Propyleneoxide 2 mol Adduct: 60 parts The above monomers are put into a flask having an internal capacity of 5 L that is provided with a stirring device, a nitrogen introducing tube, a temperature sensor, and a rectifier, and the temperature is raised to 190° C. over 1 hour. After confirming uniform stirring in the reaction system, 1.2 parts by weight of dibutyl tin oxide is added thereinto.

Furthermore, the temperature is raised to 240° C. from the above temperature over 6 hours while distilling away generated water, and dehydration condensation is further continued for 3 hours at 240° C. to obtain a binder resin (amorphous polyester resin) having an acid value of 12.0 mg/KOH, a weight average molecular weight (Mw) of 25,000, and a glass transition temperature of 65° C.

Preparation of Resin Particle Dispersion 1

Binder Resin: 160 parts
Ethyl Acetate: 233 parts
Aqueous Sodium Hydroxide (0.3 N): 0.1 part The above components are put into a 1,000 ml-separable flask, heated at 70° C., and stirred using a three-one motor (manufactured by Shinto Scientific Co., Ltd) to prepare a liquid resin mixture. While further stirring the liquid resin mixture, 373 parts of ion-exchange water is slowly added to cause phase inversion emulsification to thereby remove the solvent. Thus, a resin particle dispersion 1 (solid content concentration: 30%, volume average particle diameter: 150 nm) is obtained.

Preparation of Release Agent Dispersion

Fisher-Tropsch Wax (manufactured by Nippon Seiro Co., Ltd., FT0165): 100 parts
Anionic Surfactant (manufactured by Nippon Oil & Fats Co., Ltd., NewWreX R): 2 parts
Ion-Exchange Water: 300 parts The above components are mixed, heated at 95° C., and dispersed using a homogenizer (manufactured by TKA Werke GmbH & Co. KG, Ultra Turrax T50). Then, the dispersion treatment is performed for 360 minutes using a Manton-Gaulin high-pressure homogenizer (Gaulin Corporation) to prepare a release agent dispersion (solid content concentration: 20%) in which release agent particles having a volume average particle diameter of 0.23 μm are dispersed.

Preparation of Colorant Dispersion 1

Aluminum Pigment (manufactured by Showa Aluminum Powder K.K., 2173EA): 100 parts
Anionic Surfactant (manufactured by Daiichi Kogyo Seiyaku Co., Ltd, NEOGEN R): 1.5 parts
Ion-Exchange Water: 900 parts The solvent is removed from the aluminum pigment paste, and then the above components are mixed and dispersed for 1 hour using an emulsification-dispersing machine Cavitron (manufactured by Pacific Machinery & Engineering Co., Ltd., CR1010) to prepare a colorant dispersion 1 (solid content concentration: 10%) in which the bright pigment (aluminum pigment) is dispersed.

Preparation of Toner Particles 1

Resin Particle Dispersion 1 (First Binder Resin Particle Dispersion): 212.5 parts
Release Agent Dispersion: 25 parts
Colorant Dispersion 1: 100 parts
Nonionic Surfactant (IGEPAL CA897): 1.40 parts The above components are put into a 2 L-cylindrical stainless-steel container. Using a homogenizer (manufactured by IKA Werke GmbH & Co. KG, Ultra Turrax T50), the components are dispersed and mixed for 10 minutes at 4,000 rpm while applying a shearing force.

Next, as an aggregating agent, 1.75 parts of a 10%-nitric acid aqueous solution of polyaluminum chloride is slowly added dropwise, and the rotation rate of the homogenizer is set to 5,000 rpm to perform dispersing and mixing for 15 minutes to thereby prepare a first aggregated particle dispersion (first aggregated particle dispersion preparation process).

Next, a second aggregated particle dispersion is prepared (second aggregated particle dispersion preparation process) in the same manner as in the first aggregated particle dispersion preparation process by the use of 37.5 parts of the resin particle dispersion 1 (second binder resin particle dispersion) without using a colorant dispersion.

Next, the first aggregated particle dispersion and the second aggregated particle dispersion are mixed. The mixture of the first aggregated particle dispersion and the second aggregated particle dispersion is moved to a polymerization reactor provided with a stirring device using a stirring blade having two paddles for forming a laminar flow and a thermometer, the stirring rotation rate is set to 810 rpm and heating using a mantle heater is started to promote the growth of the aggregated particles at 54° C. (aggregation promoting process). At this time, the pH of the raw material dispersion is controlled in the range of 2.2 to 3.5 using 1 N-aqueous sodium hydroxide or 0.3 N-nitric acid. The raw material dispersion of which the pH is controlled in the above-described pH range is held for about 2 hours. At this time, the volume average particle diameter of the aggregated particles that is measured using a Multisizer II (aperture diameter: 50 μm, manufactured by Beckman Coulter, Inc) is 10.4 μm.

Next, 33.3 parts of the resin particle dispersion 1 is further added to adhere resin particles of the binder resin to the surfaces of the aggregated particles (coating layer forming process). Furthermore, the temperature is raised to 56° C., and the aggregated particles are arranged while confirming the particle size and shape using an optical microscope and the Multisizer II.

Thereafter, the pH is raised to 8.0 to coalesce the aggregated particles (coalescence process), and then the temperature is raised to 67.5° C. After confirming the coalescence of the aggregated particles using the optical microscope, the pH is lowered to 6.0 while the temperature is maintained at 67.5° C. The heating is stopped after 1 hour, and cooling is performed at a rate of temperature decrease of 1° C./min. Thereafter, the resultant material is sieved using a 40 μm-mesh, and repeatedly washed with water. Then, drying using a vacuum dryer is performed to obtain toner particles 1. The volume average particle diameter of the obtained toner particles 1 is 12.2 μm.

Preparation of Silicone Oil-Treated Inorganic Particles 1

A solution in which 30 parts by weight of a dimethyl silicone oil KF-96-065cs (Shin-Etsu Chemical Col. Ltd, kinetic viscosity at 25° C.: 0.65 $mm^2/s$) is mixed with 50 parts by weight of ethanol is prepared and sprayed to 100 parts by weight of hydrophilic silica Aerosil_OX50 (Nippon Aerosil Co., Ltd.) using spray drying to perform a surface treatment on the silica particles. The ethanol is dried and removed at 80° C., and then a silicone oil treatment (adhering) is performed while performing stirring for 1 hour at 250° C. The silicone oil-treated silica is dissolved again in ethanol (ethanol treatment) to separate a free oil. Thereafter, drying is performed to obtain "oil-treated silica" with a free oil amount of 1.5%. This is set as silicone oil-treated inorganic particles 1.

Preparation of Electrostatic Latent Image Developing Toner 1

With 100 parts of the toner particles 1 obtained as described above, 2.0 parts of the silicone oil-treated inorganic particles 1 and 0.5 part of cerium oxide (abrasive, volume average particle diameter: 0.5 μm) are blended and mixed for 30 seconds at 10,000 rpm using a sample mill. Thereafter, the mixture is sieved using a vibration sieve having with apertures of 45 μm to prepare an electrostatic latent image developing toner 1.

Measurement

The "Ratio (C/D)" and the volume average particle diameter of the obtained toner particles 1 are measured. In addition, the amount of free silicone oil and the average primary particle diameter of the obtained silicone oil-treated inorganic particles 1 are measured as described above.

Furthermore, the "ratio (A/B)" of the electrostatic latent image developing toner 1 is also measured as described above.

The measurement results are shown in Table 1.

Preparation of Carrier

Ferrite Particles (volume average particle diameter: 35 μm): 100 parts

Toluene: 14 parts

Perfluorooctyl Ethyl Acrylate-Methyl Methacrylate Copolymer (critical surface tension: 24 dyn/cm, copolymerization ratio: 2:8, weight average molecular weight: 77,000): 1.6 parts Carbon Black (trade name: VXC-72, manufactured by Cabot Co., Ltd., volume resistivity: 100 Ωcm or less): 0.12 part Crosslinked Melamine Resin Particles (average particle diameter: 0.3 μm, insoluble in toluene): 0.3 part First, the carbon black diluted with the toluene is added to the perfluorooctyl ethyl acrylate-methyl methacrylate copolymer, and the resultant material is dispersed using a sand mill. Then, the above-described components other than the ferrite particles are dispersed therein using a stirrer for 10 minutes, whereby a coating layer forming solution is prepared. The coating layer forming solution and the ferrite particles are put into a vacuum deaeration kneader, and are stirred at a temperature of 60° C. for 30 minutes. Then, the kneader is depressurized to distill away the toluene to thereby form a resin coating layer, whereby a carrier is obtained.

Preparation of Developer 36 parts of the electrostatic latent image developing toner 1 and 414 parts of the carrier are put into a 2 L-V-shaped blender, and are stirred for 20 minutes, and the resultant material is sieved with meshes of 212 μm, whereby a developer is prepared. The developer is prepared in the same manner in all of the examples.

Evaluation

Observation of Partial Wear and Scratches of Cleaning Blade

Using a modifier of DocuCentre-III C7600, manufactured by Fuji Xerox Co., ltd., A half-tone image is printed 500,000 times in a low temperature and low humidity environment (5° C., 10%) under the condition of an image density of 50%. During this period, partial wear and scratches of a cleaning blade for removing the toner remaining on a photoreceptor are observed at an initial time (100 sheets of paper) and every 100,000 times. Image defects caused by the scratches of the cleaning blade are also observed.

Regarding the wear of the blade, a part that is brought into contact with the photoreceptor is observed at a magnification of 100 times by the use of a microscope (manufactured by Keyence Corporation, VH6200) to observe a wear state and a scratch state. As for the wear state, a defect width of a blade surface brought into contact with the photoreceptor in a rotation direction (circumferential direction) of the photoreceptor, and a variation degree thereof are evaluated in a stepwise manner. As for the scratch, the number of scratches and depth are evaluated in a stepwise manner.

The evaluation standard of the partial wear and the scratch of the cleaning blade is as follows. The obtained results are shown in Table 1.

Evaluation Standard (Scratch of Blade)

AA: There are little scratches (less than 5 per unit area of 10 mm square). Very good.

A: There are light scratches (from 5 to 10 per unit area of 10 mm square). Good.

AB: There are many light scratches (from 11 to 30 per unit area of 10 mm square) with no image defects.

B: There are deep scratches (5 or less per unit area of 10 mm square) other than light scratches with no image defects. Practical level for use.

C: There are deep scratches (6 or more per unit area of 10 mm square). Black dots are generated as image defects.

D: There are many scratches and black dots and deletion are generated as image defects.

E: There are many scratches and many black dots and deletion are generated as image defects.

Evaluation Standard (Partial Wear of Blade)

AA: Wear is observed, but there are only minor defect widths (less than 1 mm) with evenness. Very good.

A: Minor defect widths (from 1 mm to 2 mm) with evenness. Good.

AB: Minor defect widths (from 1 mm to 2 mm) with slight unevenness (1 to 3 defects with a width of 3.5 mm or greater).

B: Moderate defect widths (from 2.1 mm to 3 mm) with unevenness (4 to 6 defects with a width of 3.5 mm or greater). There is no slipping of a toner. Practical level for use with no defects such as image defects.

C: Moderate defect widths (from 2.1 mm to 3 mm) with increasing unevenness (from 7 to 10 defects with a width of 3.5 mm or greater). There is slipping of a toner and 1 to 3 black strips are generated on an image.

D: Large defect widths (3.1 mm or greater) with great unevenness (11 defects or more with a width of 3.6 mm or greater). 4 or more black strips are generated on an image.

E: There are many missing parts on the blade and many image defects (black strips and black dots) are generated.

Brilliance

A solid image is formed using the following method.

A developing machine of DocuCentre-III C7600, manufactured by Fuji Xerox Co, ltd., is filled with a developer as a sample, and a solid image in which the amount of the toner is 4.5 g/m$^2$ is formed on a recording sheet (an OK top-coated+ sheet of paper, manufactured by Oji Paper Co., Ltd.) at a fixing temperature of 190° C. with a fixing pressure of 4.0 kg/cm$^2$.

A solid image obtained after an image with a printing area of 1.0% is formed on 10,000 recording sheets described above at a high temperature of 32° C. with a high humidity of 80% RH is viewed with the naked eye under illumination for color observation (natural daylight illumination) according to JIS K 5600-4-3: 1999, "Testing methods for paints—Part 4: Visual characteristics of film—Section 3: Visual comparison of the colour of paints" to evaluate the brilliance.

The evaluation is carried out in accordance with the determination by 10 subjects, and the evaluation standard is as follows.

The obtained results are shown in Table 1.

Evaluation Standard

AA: 9 or more subjects determine that the brilliance is good. Very good.

A: 8 subjects determine that the brilliance is good. Good.

AB: 7 subjects determine that the brilliance is good. Quite good.

B: 6 subjects determine that the brilliance is good. Practical level for use.

C: 5 subjects determine that the brilliance is good. Quite poor.

D: 6 to 8 subjects determine that the brilliance is poor. Poor.

E: 9 or more subjects determine that the brilliance is poor. Very poor.

Examples 2 to 38

Preparation of Resin Particle Dispersion 2

The amount of ethyl acetate is set to 350 parts and the amount of sodium hydroxide is set to 1.0 part in the preparation of the resin dispersion 1 to obtain a resin particle dispersion 2 (solid content concentration: 30%, volume average particle diameter: 60 nm).

Preparation of Resin Particle Dispersion 3

The amount of ethyl acetate is set to 100 parts and the amount of sodium hydroxide is set to 0.05 part in the preparation of the resin dispersion 1 to obtain a resin particle dispersion 3 (solid content concentration: 30%, volume average particle diameter: 350 nm).

Preparation of Colorant Dispersion 2

A colorant dispersion 2 (solid content concentration: 10%) is prepared in the same manner as in the case of the colorant dispersion 1, except that a pearl pigment (manufactured by Merck KGaA, Iriodin® 111 Rutile Fine Satin) is used in place of the aluminum pigment.

Preparation of Toner Particles 2

Toner particles 2 are obtained in the same manner as in the case of the toner particles 1, except that the amount of the first binder resin dispersion is set to 220 parts and the amount of the second binder resin dispersion is set to 30 parts in the preparation of the toner particles 1.

Preparation of Toner Particles 3

Toner particles 3 are obtained in the same manner as in the case of the toner particles 1, except that the resin dispersion 3 is used in place of the resin dispersion 1 in the preparation of the toner particles 1.

Preparation of Toner Particles 4

Toner particles 4 are obtained in the same manner as in the case of the toner particles 2, except that the resin dispersion 2 is used in place of the resin dispersion 1 in the preparation of the toner particles 1.

Preparation of Toner Particles 5

Toner particles 5 are obtained in the same manner as in the case of the toner particles 1, except that the resin dispersion 3 is used in place of the resin dispersion 1, the amount of the first binder resin dispersion is set to 200 parts, the amount of the second binder resin dispersion is set to 30 parts, and the amount of the resin dispersion further added is set to 53.3 parts in the preparation of the toner particles 1.

Preparation of Toner Particles 6

Toner particles 6 are obtained in the same manner as in the case of the toner particles 1, except that the resin dispersion 2 is used in place of the resin dispersion 1, the amount of the first binder resin dispersion is set to 250 parts, the amount of the second binder resin dispersion is set to 20 parts, and the amount of the resin dispersion further added is set to 13.3 parts in the preparation of the toner particles 1.

Preparation of Toner Particles 7

Toner particles 7 are obtained in the same manner as in the case of the toner particles 1, except that the resin dispersion 3 is used in place of the resin dispersion 1, the amount of the first binder resin dispersion is set to 180 parts, the amount of the second binder resin dispersion is set to 50 parts, and the amount of the resin dispersion further added is set to 53.3 parts in the preparation of the toner particles 1.

Preparation of Toner Particles 8

Toner particles 8 are obtained in the same manner as in the case of the toner particles 1, except that the resin dispersion 2 is used in place of the resin dispersion 1, the amount of the first binder resin dispersion is set to 260 parts, the amount of the second binder resin dispersion is set to 10 parts, and the amount of the resin dispersion further added is set to 13.3 parts in the preparation of the toner particles 1.

Preparation of Toner Particles 9

Toner particles 9 are obtained in the same manner as in the case of the toner particles 1, except that the resin dispersion 3 is used in place of the resin dispersion 1, the amount of the first binder resin dispersion is set to 150 parts, the amount of the second binder resin dispersion is set to 50 parts, and the amount of the resin dispersion further added is set to 83.3 parts in the preparation of the toner particles 1.

Preparation of Toner Particles 10

Toner particles 10 are obtained in the same manner as in the case of the toner particles 1, except that the resin dispersion 2 is used in place of the resin dispersion 1, the amount of the first binder resin dispersion is set to 270 parts, the amount of the second binder resin dispersion is set to 5 parts, and the amount of the resin dispersion further added is set to 8.3 parts in the preparation of the toner particles 1.

Preparation of Toner Particles 11

Toner particles 11 are obtained in the same manner as in the case of the toner particles 1, except that the resin dispersion 3 is used in place of the resin dispersion 1, the amount of the first binder resin dispersion is set to 130 parts, the amount of the second binder resin dispersion is set to 70 parts, and the amount of the resin dispersion further added is set to 83.3 parts in the preparation of the toner particles 1.

Preparation of Toner Particles 12

Toner particles 12 are obtained in the same manner as in the case of the toner particles 1, except that the colorant dispersion 2 is used in place of the colorant dispersion 1 in the preparation of the toner particles 1.

Preparation of Toner Particles 13

Toner particles 13 are obtained in the same manner as in the case of the toner particles 1, except that the resin dispersion 2 is used in place of the resin dispersion 1, the amount of the first binder resin dispersion is set to 280 parts, the second binder resin dispersion is not added, and the amount of the resin dispersion further added is set to 3.3 parts in the preparation of the toner particles 1.

Preparation of Toner Particles 14

Toner particles 14 are obtained in the same manner as in the case of the toner particles 1, except that the resin dispersion 3 is used in place of the resin dispersion 1, the amount of the first binder resin dispersion is set to 110 parts, the amount of the second binder resin dispersion is set to 90 parts, and the amount of the resin dispersion further added is set to 83.3 parts in the preparation of the toner particles 1.

Preparation of Silicone Oil-Treated Inorganic Particles 2

The same materials as those of the silicone oil-treated inorganic particles 1 are used, and the amount of dimethyl silicone oil is changed to 5 parts by weight to perform a surface treatment on silica particles. The ethanol is dried and removed at 80° C., and then a silicone oil treatment (adhering) is performed while performing stirring for 0.5 hour at 250° C. The silicone oil-treated silica is dissolved again in ethanol (ethanol treatment) to separate a free oil. Thereafter, drying is performed to obtain "oil-treated silica 2" with a free oil amount of 0.49%.

Preparation of Silicone Oil-Treated Inorganic Particles 3

The same materials as those of the silicone oil-treated inorganic particles 1 are used, and the amount of dimethyl silicone oil is changed to 50 parts by weight to perform a surface treatment on silica particles. The ethanol is dried and removed at 80° C., and then a silicone oil treatment (adhering) is performed while performing stirring for 2 hours at 250° C. The silicone oil-treated silica is dissolved again in ethanol (ethanol treatment) to separate a free oil. Thereafter, drying is performed to obtain "oil-treated silica 3" with a free oil amount of 2.1%.

Preparation of Silicone Oil-Treated Inorganic Particles 4

The same materials as those of the silicone oil-treated inorganic particles 1 are used, and the amount of dimethyl silicone oil is changed to 7 parts by weight to perform a surface treatment on silica particles. The ethanol is dried and removed at 80° C., and then a silicone oil treatment (adhering) is performed while performing stirring for 0.5 hour at 250° C. The silicone oil-treated silica is dissolved again in ethanol (ethanol treatment) to separate a free oil. Thereafter, drying is performed to obtain "oil-treated silica 4" with a free oil amount of 0.51%.

Preparation of Silicone Oil-Treated Inorganic Particles 5

The same materials as those of the silicone oil-treated inorganic particles 1 are used, and the amount of dimethyl silicone oil is changed to 40 parts by weight to perform a surface treatment on silica particles. The ethanol is dried and removed at 80° C., and then a silicone oil treatment (adhering) is performed while performing stirring for 1.5 hours at 250° C. The silicone oil-treated silica is dissolved again in ethanol (ethanol treatment) to separate a free oil. Thereafter, drying is performed to obtain "oil-treated silica 5" with a free oil amount of 1.9%.

Preparation of Silicone Oil-Treated Inorganic Particles 6

The same materials as those of the silicone oil-treated inorganic particles 1 are used, and the amount of dimethyl silicone oil is changed to 5 parts by weight to perform a surface treatment on silica particles. The ethanol is dried and removed at 80° C., and then a silicone oil treatment (adhering) is performed while performing stirring for 0.5 hour at 250° C. The silicone oil-treated silica is dissolved again in ethanol (ethanol treatment) to separate a free oil. Thereafter, drying is performed to obtain "oil-treated silica 6" with a free oil amount of 0.29%.

Preparation of Silicone Oil-Treated Inorganic Particles 7

The same materials as those of the silicone oil-treated inorganic particles 1 are used, and the amount of dimethyl silicone oil is changed to 50 parts by weight to perform a surface treatment on silica particles. The ethanol is dried and removed at 80° C., and then a silicone oil treatment (adhering) is performed while performing stirring for 5 hours at 250° C. The silicone oil-treated silica is dissolved again in ethanol (ethanol treatment) to separate a free oil. Thereafter, drying is performed to obtain "oil-treated silica 7" with a free oil amount of 3.1%.

Preparation of Silicone Oil-Treated Inorganic Particles 8

"Oil-treated silica 8" with a free oil amount of 0.4% is obtained in the same manner as in the case of the inorganic particles 4, except that the dimethyl silicone oil is changed to an amino-modified silicone oil in the silicone oil-treated inorganic particles 4.

Preparation of Silicone Oil-Treated Inorganic Particles 9

"Oil-treated silica 9" with a free oil amount of 2.9% is obtained in the same manner as in the case of the inorganic particles 7, except that the dimethyl silicone oil is changed to an amino-modified silicone oil in the silicone oil-treated inorganic particles 7.

Preparation of Silicone Oil-Treated Inorganic Particles 10

"Oil-treated silica 10" with a free oil amount of 0.2% is obtained in the same manner as in the case of the inorganic particles 6, except that the dimethyl silicone oil is changed to an amino-modified silicone oil in the silicone oil-treated inorganic particles 6.

Preparation of Silicone Oil-Treated Inorganic Particles 11

"Oil-treated silica 11" with a free oil amount of 4.9% is obtained in the same manner as in the case of the inorganic particles 7, except that the dimethyl silicone oil is changed to an amino-modified silicone oil in the silicone oil-treated inorganic particles 6.

Preparation of Silicone Oil-Treated Inorganic Particles 12

First, hydrophilic silica is prepared using the following sol-gel method.

300 parts by weight of ethanol and 46.7 parts by weight of 10% ammonia water are put into a reactor made of glass with a capacity of 3 L that has a stirrer made of metal, a dropping nozzle (microtube pump made of Teflon (registered trademark)), and a thermometer. These are stirred and mixed to obtain an alkali catalyst solution.

Next, The temperature of the alkali catalyst solution is adjusted to 25° C., and the alkali catalyst solution is subjected to nitrogen substitution. Then, while stirring the alkali catalyst solution, 450 parts by weight of tetraethoxysilane (TEOS) and 270 parts by weight of ammonia water with a catalyst ($NH_3$) concentration of 4.44% are added dropwise at the same time at the following supply rates to obtain a suspension of the silica particles (silica particle suspension).

Here, the supply rate of tetraethoxysilane is 7.08 parts by weight/min, and the supply rate of 4.44% ammonia water is 4.25 parts by weight/min.

When the particles of the obtained silica particle suspension are subjected to the measurement using a known particle size measuring apparatus, the average primary particle diameter is 28 nm.

Next, the obtained suspension of the hydrophilic silica particles (hydrophilic silica particle dispersion) is dried using spray drying to remove the solvent, whereby a hydrophilic silica particle powder is obtained.

The hydrophilic silica obtained in this manner is treated with a silicone oil under the same conditions as in the preparation of the silicone oil-treated inorganic particles 1 to obtain "oil-treated silica 12" with a free oil amount of 1.50.

Preparation of Silicone Oil-Treated Inorganic Particles 13

The silicone oil treatment is performed under the same conditions as in the preparation of the silicone oil-treated inorganic particles 1, except that the amount of 10% ammonia water that is an alkali catalyst is changed from 46.7 parts by weight to 46.8 parts by weight in the preparation of hydrophilic silica using a sol-gel method to obtain a hydrophilic silica particle suspension having an average primary particle diameter of 32 nm. Whereby "oil-treated silica 13" with a free oil amount of 1.5% is obtained.

Preparation of Silicone Oil-Treated Inorganic Particles 14

The silicone oil treatment is performed under the same conditions as in the preparation of the silicone oil-treated inorganic particles 1, except that the amount of 10% ammonia water that is an alkali catalyst is set to 47.0 parts by weight in the preparation of hydrophilic silica using a sol-gel method to obtain a hydrophilic silica particle suspension having an average primary particle diameter of 38 nm. Whereby "oil-treated silica 14" with a free oil amount of 1.5% is obtained.

Preparation of Silicone Oil-Treated Inorganic Particles 15

The silicone oil treatment is performed under the same conditions as in the preparation of the silicone oil-treated inorganic particles 1, except that the amount of 10% ammonia water that is an alkali catalyst is set to 47.1 parts by weight in the preparation of hydrophilic silica using a sol-gel method to obtain a hydrophilic silica particle suspension having an average primary particle diameter of 42 nm. Whereby "oil-treated silica 15" with a free oil amount of 1.5% is obtained.

Preparation of Silicone Oil-Treated Inorganic Particles 16

The silicone oil treatment is performed under the same conditions as in the preparation of the silicone oil-treated inorganic particles 1, except that the amount of 10% ammonia water that is an alkali catalyst is set to 47.2 parts by weight in the preparation of hydrophilic silica using a sol-gel method to obtain a hydrophilic silica particle suspension having an average primary particle diameter of 48 nm. Whereby "oil-treated silica 16" with a free oil amount of 1.5% is obtained.

Preparation of Silicone Oil-Treated Inorganic Particles 17

The silicone oil treatment is performed under the same conditions as in the preparation of the silicone oil-treated inorganic particles 1, except that the amount of 10% ammonia water that is an alkali catalyst is set to 47.3 parts by weight in the preparation of hydrophilic silica using a sol-gel method to obtain a hydrophilic silica particle suspension having an average primary particle diameter of 52 nm. Whereby "oil-treated silica 17" with a free oil amount of 1.5% is obtained.

Preparation of Silicone Oil-Treated Inorganic Particles 18

The silicone oil treatment is performed under the same conditions as in the preparation of the silicone oil-treated inorganic particles 1, except that the amount of 10% ammonia water that is an alkali catalyst is set to 49.6 parts by weight in the preparation of hydrophilic silica using a sol-gel method to obtain a hydrophilic silica particle suspension having an average primary particle diameter of 148 nm. Whereby "oil-treated silica 18" with a free oil amount of 1.5% is obtained.

Preparation of Silicone Oil-Treated Inorganic Particles 19

The silicone oil treatment is performed under the same conditions as in the preparation of the silicone oil-treated inorganic particles 1, except that the amount of 10% ammonia water that is an alkali catalyst is set to 49.7 parts by weight in the preparation of hydrophilic silica using a sol-gel method to obtain a hydrophilic silica particle suspension having an average primary particle diameter of 152 nm. Whereby "oil-treated silica 19" with a free oil amount of 1.5% is obtained.

Preparation of Silicone Oil-Treated Inorganic Particles 20

The silicone oil treatment is performed under the same conditions as in the preparation of the silicone oil-treated inorganic particles 1, except that the amount of 10% ammonia water that is an alkali catalyst is set to 50.2 parts by weight in the preparation of hydrophilic silica using a sol-gel method to obtain a hydrophilic silica particle suspension having an average primary particle diameter of 178 nm. Whereby "oil-treated silica 20" with a free oil amount of 1.5% is obtained.

Preparation of Silicone Oil-Treated Inorganic Particles 21

The silicone oil treatment is performed under the same conditions as in the preparation of the silicone oil-treated inorganic particles 1, except that the amount of 10% ammonia water that is an alkali catalyst is set to 50.4 parts by weight in the preparation of hydrophilic silica using a sol-gel method to obtain a hydrophilic silica particle suspension having an average primary particle diameter of 182 nm. Whereby "oil-treated silica 21" with a free oil amount of 1.5% is obtained.

Preparation of Silicone Oil-Treated Inorganic Particles 22

The silicone oil treatment is performed under the same conditions as in the preparation of the silicone oil-treated inorganic particles 1, except that the amount of 10% ammonia water that is an alkali catalyst is set to 50.7 parts by weight in the preparation of hydrophilic silica using a sol-gel method to obtain a hydrophilic silica particle suspension having an average primary particle diameter of 198 nm. Whereby "oil-treated silica 22" with a free oil amount of 1.5% is obtained.

Preparation of Silicone Oil-Treated Inorganic Particles 23

The silicone oil treatment is performed under the same conditions as in the preparation of the silicone oil-treated inorganic particles 1, except that the amount of 10% ammonia water that is an alkali catalyst is set to 50.9 parts by weight in the preparation of hydrophilic silica using a sol-gel method to obtain a hydrophilic silica particle suspension having an average primary particle diameter of 202 nm. Whereby "oil-treated silica 23" with a free oil amount of 1.5% is obtained.

Preparation of Silicone Oil-Treated Inorganic Particles 24

A solution in which 30 parts by weight of a dimethyl silicone oil KF-96-065cs (Shin-Etsu Chemical Col. Ltd, kinetic viscosity at 25° C.: 0.65 $mm^2/s$) is mixed with 50 parts by weight of ethanol is prepared and sprayed to 100 parts by weight of hydrophilic titanium MT-600B (Teika K.K., average primary particle diameter: 50 nm) using spray drying to perform a surface treatment on the titanium particles. The ethanol is dried and removed at 80° C., and then a silicone oil treatment (adhering) is performed while performing stirring for 1 hour at 200° C. The silicone oil-treated titanium is dissolved again in ethanol (ethanol treatment) to separate a free oil. Thereafter, drying is performed to obtain "oil-treated titanium" with a free oil amount of 1.5%.

Preparation of Silicone Oil-Treated Inorganic Particles 25

A solution in which 30 parts by weight of a dimethyl silicone oil KF-96-065cs (Shin-Etsu Chemical Col. Ltd, kinetic viscosity at 25° C.: 0.65 $mm^2/s$) is mixed with 50 parts by weight of ethanol is prepared and sprayed to 100 parts by weight of alumina particles (HIT-70: manufactured by Sumitomo Chemical Co., Ltd., average primary particle diameter: 150 nm) using spray drying to perform a surface treatment on the alumina particles. The ethanol is dried and removed at 80° C., and then a silicone oil treatment (adhering) is performed while performing stirring for 1 hour at 230° C. The silicone oil-treated alumina is dissolved again in ethanol (ethanol treatment) to separate a free oil. Thereafter, drying is performed to obtain "oil-treated alumina" with a free oil amount of 1.5%.

Preparation of Inorganic Particles 26

Untreated hydrophilic silica Aerosil_OX50 (Nippon Aerosil Co., Ltd.), that is not treated with a silicone oil, is used.

Preparation of Silicone Oil-Treated Inorganic Particles 27

In the silicone oil-treated inorganic particles 10, the silicone-oil treated silica is dissolved again in ethanol (ethanol treatment) to separate a free oil. After repeating the dissolution in ethanol once again, drying is performed to obtain "oil-treated silica 27" with a free oil amount of 0.09%.

Preparation of Silicone Oil-Treated Inorganic Particles 28

The same materials as those of the silicone oil-treated inorganic particles 1 are used, and the amount of dimethyl silicone oil is changed to 100 parts by weight to perform a surface treatment on silica particles. The ethanol is dried and removed at 80° C., and then a silicone oil treatment (adhering) is performed while performing stirring for 5 hours at 250° C. The silicone oil-treated silica is dissolved again in isopropanol (isopropanol treatment) to separate a free oil. Thereafter, drying is performed to obtain "oil-treated silica 28" with a free oil amount of 10.1%.

Preparation of Electrostatic Latent Image Developing Toner 2

An electrostatic latent image developing toner 2 is prepared in the same manner as in the case of the electrostatic latent image developing toner 1, except that 2.0 parts of the silicone oil-treated inorganic particles 2 is used.

Preparation of Electrostatic Latent Image Developing Toner 3

An electrostatic latent image developing toner 3 is prepared in the same manner as in the case of the electrostatic latent image developing toner 1, except that 2.0 parts of the silicone oil-treated inorganic particles 3 is used.

Preparation of Electrostatic Latent Image Developing Toner 4

An electrostatic latent image developing toner 4 is prepared in the same manner as in the case of the electrostatic latent image developing toner 1, except that 2.0 parts of the silicone oil-treated inorganic particles 4 is used.

Preparation of Electrostatic Latent Image Developing Toner 5

An electrostatic latent image developing toner 5 is prepared in the same manner as in the case of the electrostatic latent image developing toner 1, except that 2.0 parts of the silicone oil-treated inorganic particles 5 is used.

Preparation of Electrostatic Latent Image Developing Toner 6

An electrostatic latent image developing toner 6 is prepared in the same manner as in the case of the electrostatic latent image developing toner 1, except that 2.0 parts of the silicone oil-treated inorganic particles 6 is used.

Preparation of Electrostatic Latent Image Developing Toner 7

An electrostatic latent image developing toner 7 is prepared in the same manner as in the case of the electrostatic latent image developing toner 1, except that 2.0 parts of the silicone oil-treated inorganic particles 7 is used.

Preparation of Electrostatic Latent Image Developing Toner 8

An electrostatic latent image developing toner 8 is prepared in the same manner as in the case of the electrostatic latent image developing toner 1, except that 2.0 parts of the silicone oil-treated inorganic particles 8 is used.

Preparation of Electrostatic Latent Image Developing Toner 9

An electrostatic latent image developing toner 9 is prepared in the same manner as in the case of the electrostatic latent image developing toner 1, except that 2.0 parts of the silicone oil-treated inorganic particles 9 is used.

Preparation of Electrostatic Latent Image Developing Toner 10

An electrostatic latent image developing toner 10 is prepared in the same manner as in the case of the electrostatic latent image developing toner 1, except that 2.0 parts of the silicone oil-treated inorganic particles 10 is used.

Preparation of Electrostatic Latent Image Developing Toner 11

An electrostatic latent image developing toner 11 is prepared in the same manner as in the case of the electrostatic latent image developing toner 1, except that 2.0 parts of the silicone oil-treated inorganic particles 11 is used.

Preparation of Electrostatic Latent Image Developing Toner 12

An electrostatic latent image developing toner 12 is prepared in the same manner as in the case of the electrostatic latent image developing toner 1, except that the toner particles 2 are used.

Preparation of Electrostatic Latent Image Developing Toner 13

An electrostatic latent image developing toner 13 is prepared in the same manner as in the case of the electrostatic latent image developing toner 1, except that the toner particles 3 are used.

Preparation of Electrostatic Latent Image Developing Toner 14

An electrostatic latent image developing toner 14 is prepared in the same manner as in the case of the electrostatic latent image developing toner 1, except that the toner particles 4 are used.

Preparation of Electrostatic Latent Image Developing Toner 15

An electrostatic latent image developing toner 15 is prepared in the same manner as in the case of the electrostatic latent image developing toner 1, except that the toner particles 5 are used.

Preparation of Electrostatic Latent Image Developing Toner 16

An electrostatic latent image developing toner 16 is prepared in the same manner as in the case of the electrostatic latent image developing toner 1, except that the toner particles 6 are used.

Preparation of Electrostatic Latent Image Developing Toner 17

An electrostatic latent image developing toner 17 is prepared in the same manner as in the case of the electrostatic latent image developing toner 1, except that the toner particles 7 are used.

Preparation of Electrostatic Latent Image Developing Toner 18

An electrostatic latent image developing toner 18 is prepared in the same manner as in the case of the electrostatic latent image developing toner 1, except that the toner particles 8 are used.

Preparation of Electrostatic Latent Image Developing Toner 19

An electrostatic latent image developing toner 19 is prepared in the same manner as in the case of the electrostatic latent image developing toner 1, except that the toner particles 9 are used.

Preparation of Electrostatic Latent Image Developing Toner 20

An electrostatic latent image developing toner 20 is prepared in the same manner as in the case of the electrostatic latent image developing toner 1, except that the toner particles 10 are used.

Preparation of Electrostatic Latent Image Developing Toner 21

An electrostatic latent image developing toner 21 is prepared in the same manner as in the case of the electrostatic latent image developing toner 1, except that the toner particles 11 are used.

Preparation of Electrostatic Latent Image Developing Toner 22

An electrostatic latent image developing toner 22 is prepared in the same manner as in the case of the electrostatic latent image developing toner 1, except that with 100 parts of the toner particles 1, 0.11 part of the silicone oil-treated inorganic particles 1 and 0.5 part of cerium oxide (abrasive, volume average particle diameter: 0.5 μm) are blended and mixed for 30 seconds at 10,000 rpm using a sample mill.

Preparation of Electrostatic Latent Image Developing Toner 23

An electrostatic latent image developing toner 23 is prepared in the same manner as in the case of the electrostatic latent image developing toner 1, except that with 100 parts of the toner particles 1, 9.9 parts of the silicone oil-treated inorganic particles 1 and 0.5 part of cerium oxide (abrasive, volume average particle diameter: 0.5 μm) are blended and mixed for 30 seconds at 10,000 rpm using a sample mill.

Preparation of Electrostatic Latent Image Developing Toner 24

An electrostatic latent image developing toner 24 is prepared in the same manner as in the case of the electrostatic latent image developing toner 1, except that 2.0 parts of the silicone oil-treated inorganic particles 13 is used.

Preparation of Electrostatic Latent Image Developing Toner 25

An electrostatic latent image developing toner 25 is prepared in the same manner as in the case of the electrostatic latent image developing toner 1, except that 2.0 parts of the silicone oil-treated inorganic particles 22 is used.

Preparation of Electrostatic Latent Image Developing Toner 26

An electrostatic latent image developing toner 26 is prepared in the same manner as in the case of the electrostatic latent image developing toner 1, except that 2.0 parts of the silicone oil-treated inorganic particles 12 is used.

Preparation of Electrostatic Latent Image Developing Toner 27

An electrostatic latent image developing toner 27 is prepared in the same manner as in the case of the electrostatic latent image developing toner 1, except that 2.0 parts of the silicone oil-treated inorganic particles 23 is used.

Preparation of Electrostatic Latent Image Developing Toner 28

An electrostatic latent image developing toner 28 is prepared in the same manner as in the case of the electrostatic latent image developing toner 1, except that 2.0 parts of the silicone oil-treated inorganic particles 15 is used.

Preparation of Electrostatic Latent Image Developing Toner 29

An electrostatic latent image developing toner 29 is prepared in the same manner as in the case of the electrostatic latent image developing toner 1, except that 2.0 parts of the silicone oil-treated inorganic particles 20 is used.

Preparation of Electrostatic Latent Image Developing Toner 30

An electrostatic latent image developing toner 30 is prepared in the same manner as in the case of the electrostatic latent image developing toner 1, except that 2.0 parts of the silicone oil-treated inorganic particles 14 is used.

Preparation of Electrostatic Latent Image Developing Toner 31

An electrostatic latent image developing toner 31 is prepared in the same manner as in the case of the electrostatic latent image developing toner 1, except that 2.0 parts of the silicone oil-treated inorganic particles 21 is used.

Preparation of Electrostatic Latent Image Developing Toner 32

An electrostatic latent image developing toner 32 is prepared in the same manner as in the case of the electrostatic latent image developing toner 1, except that 2.0 parts of the silicone oil-treated inorganic particles 17 is used.

Preparation of Electrostatic Latent Image Developing Toner 33

An electrostatic latent image developing toner 33 is prepared in the same manner as in the case of the electrostatic latent image developing toner 1, except that 2.0 parts of the silicone oil-treated inorganic particles 18 is used.

Preparation of Electrostatic Latent Image Developing Toner 34

An electrostatic latent image developing toner 34 is prepared in the same manner as in the case of the electrostatic latent image developing toner 1, except that 2.0 parts of the silicone oil-treated inorganic particles 16 is used.

Preparation of Electrostatic Latent Image Developing Toner 35

An electrostatic latent image developing toner 35 is prepared in the same manner as in the case of the electrostatic latent image developing toner 1, except that 2.0 parts of the silicone oil-treated inorganic particles 19 is used.

Preparation of Electrostatic Latent Image Developing Toner 36

An electrostatic latent image developing toner 36 is prepared in the same manner as in the case of the electrostatic latent image developing toner 1, except that 2.0 parts of the silicone oil-treated inorganic particles 24 is used.

Preparation of Electrostatic Latent Image Developing Toner 37

An electrostatic latent image developing toner 37 is prepared in the same manner as in the case of the electrostatic latent image developing toner 1, except that 2.0 parts of the silicone oil-treated inorganic particles 25 is used.

Preparation of Electrostatic Latent Image Developing Toner 38

An electrostatic latent image developing toner 38 is prepared in the same manner as in the case of the electrostatic latent image developing toner 1, except that the toner particles 12 are used.

Preparation and Evaluation of Developer

Developers are prepared using the method described in Example 1, except that the electrostatic latent image developing toner 1 of Example 1 is replaced by the electrostatic latent image developing toners 2 to 38, and evaluation is performed in the same manner as in Example 1.

Comparative Example 1

An electrostatic latent image developing toner is obtained in the same manner as in Example 1, except that the silicone oil-treated inorganic particles 1 used in the process of manufacturing the electrostatic latent image developing toner in Example 1 are replaced by inorganic particles (No. 26) that are not treated with a silicone oil (the amount of free silicone oil is 0).

In addition, by the use of this electrostatic latent image developing toner, a developer is prepared using the method described in the example, and evaluation is performed in the same manner as in Example 1.

The evaluation results are shown in Table 1.

Comparative Examples 2 and 3

Electrostatic latent image developing toners are obtained in the same manner as in Example 1, except that in Comparative Example 2, the silicone oil-treated inorganic particles 1 used in the process of manufacturing the electrostatic latent image developing toner in Example 1 are replaced by inorganic particles (No. 27) in which the amount of free silicone oil is 0.09% by weight, and in Comparative Example 3, the above silicone oil-treated inorganic particles 1 are replaced by inorganic particles (No. 28) in which the amount of free silicone oil is 10.1% by weight.

By the use of the electrostatic latent image developing toners obtained as described above, developers are prepared using the method described in the example, and evaluation is performed in the same manner as in Example 1.

The evaluation results are shown in Table 1.

Comparative Examples 4 and 5

Electrostatic latent image developing toners are obtained in the same manner as in Example 1, except that in Comparative Example 4, the toner particles 1 used in the process of manufacturing the electrostatic latent image developing toner in Example 1 are replaced by the toner particles 13 in which the ratio (C/D) is 0.04, and in Comparative Example 5, the above toner particles 1 are replaced by the toner particles 14 in which the ratio (C/D) is 0.71.

The above toner particles are prepared as follows.

By the use of the electrostatic latent image developing toners obtained as described above, developers are prepared using the method described in the example, and evaluation is performed in the same manner as in Example 1.

The evaluation results are shown in Table 1.

TABLE 1

| | Toner Particles | | Inorganic Particles | | | | | Evaluation Results | | |
|---|---|---|---|---|---|---|---|---|---|---|
| | No. | Ratio (C/D) | No. | Amount of Free Silicone Oil (wt %) | Average Primary Particle Diameter (nm) | Amount Added (wt %) | Ratio (A/B) | Scratches of Blade | Partial Wear of Blade | Brilliance |
| Example 1 | 1 | 0.2 | 1 | 1.5 | 70 | 2 | 50 | AA | AA | AA |
| Example 2 | 1 | 0.2 | 2 | 0.49 | 70 | 2 | 50 | AB | A | AA |
| Example 3 | 1 | 0.2 | 3 | 2.1 | 70 | 2 | 50 | AA | A | AA |
| Example 4 | 1 | 0.2 | 4 | 0.51 | 70 | 2 | 50 | AB | AB | AA |
| Example 5 | 1 | 0.2 | 5 | 1.9 | 70 | 2 | 50 | AA | A | AA |
| Example 6 | 1 | 0.2 | 6 | 0.29 | 70 | 2 | 50 | B | B | AA |
| Example 7 | 1 | 0.2 | 7 | 3.1 | 70 | 2 | 50 | AA | A | AA |
| Example 8 | 1 | 0.2 | 8 | 0.4 | 70 | 2 | 50 | AB | AB | AA |
| Example 9 | 1 | 0.2 | 9 | 2.9 | 70 | 2 | 50 | AA | A | AA |
| Example 10 | 1 | 0.2 | 10 | 0.2 | 70 | 2 | 50 | B | B | AA |
| Example 11 | 1 | 0.2 | 11 | 4.9 | 70 | 2 | 50 | AA | AB | AA |
| Example 12 | 2 | 0.15 | 1 | 1.5 | 70 | 2 | 74 | AB | B | AA |
| Example 13 | 3 | 0.65 | 1 | 1.5 | 70 | 2 | 21 | AA | A | AB |
| Example 14 | 4 | 0.13 | 1 | 1.5 | 70 | 2 | 76 | AB | B | AA |
| Example 15 | 5 | 0.67 | 1 | 1.5 | 70 | 2 | 19 | AA | A | AB |
| Example 16 | 6 | 0.11 | 1 | 1.5 | 70 | 2 | 84 | AB | B | AA |
| Example 17 | 7 | 0.68 | 1 | 1.5 | 70 | 2 | 11 | AA | A | B |
| Example 18 | 8 | 0.09 | 1 | 1.5 | 70 | 2 | 86 | B | B | AA |
| Example 19 | 9 | 0.69 | 1 | 1.5 | 70 | 2 | 9 | AA | AB | B |
| Example 20 | 10 | 0.05 | 1 | 1.5 | 70 | 2 | 94 | B | B | AA |
| Example 21 | 11 | 0.7 | 1 | 1.5 | 70 | 2 | 6 | AA | AB | B |
| Example 22 | 1 | 0.2 | 1 | 1.5 | 70 | 0.11 | 50 | B | AB | A |
| Example 23 | 1 | 0.2 | 1 | 1.5 | 70 | 9.9 | 50 | AB | A | AB |
| Example 24 | 1 | 0.2 | 13 | 1.5 | 32 | 2 | 50 | AB | A | AA |
| Example 25 | 1 | 0.2 | 22 | 1.5 | 198 | 2 | 50 | AB | AB | AB |
| Example 26 | 1 | 0.2 | 12 | 1.5 | 28 | 2 | 50 | AB | A | AA |
| Example 27 | 1 | 0.2 | 23 | 1.5 | 202 | 2 | 50 | AB | AB | AB |
| Example 28 | 1 | 0.2 | 15 | 1.5 | 42 | 2 | 50 | A | A | AA |
| Example 29 | 1 | 0.2 | 20 | 1.5 | 178 | 2 | 50 | AB | AB | AB |
| Example 30 | 1 | 0.2 | 14 | 1.5 | 38 | 2 | 50 | A | A | AA |
| Example 31 | 1 | 0.2 | 21 | 1.5 | 182 | 2 | 50 | AB | AB | A |
| Example 32 | 1 | 0.2 | 17 | 1.5 | 52 | 2 | 50 | AA | AA | AA |
| Example 33 | 1 | 0.2 | 18 | 1.5 | 148 | 2 | 50 | AA | AB | A |
| Example 34 | 1 | 0.2 | 16 | 1.5 | 48 | 2 | 50 | A | AA | AA |
| Example 35 | 1 | 0.2 | 19 | 1.5 | 152 | 2 | 50 | AB | AB | A |
| Example 36 | 1 | 0.2 | 24 | 1.5 | 50 | 2 | 50 | A | AB | AA |
| Example 37 | 1 | 0.2 | 25 | 1.5 | 150 | 2 | 50 | AA | AB | A |
| Example 38 | 12 | 0.2 | 1 | 1.5 | 70 | 2 | 50 | A | A | B |
| Comparative Example 1 | 1 | 0.2 | 26 | None | 70 | 2 | 50 | E | E | D |
| Comparative Example 2 | 1 | 0.2 | 27 | 0.09 | 70 | 2 | 50 | D | C | A |
| Comparative Example 3 | 1 | 0.2 | 28 | 10.1 | 70 | 2 | 50 | AA | A | D |
| Comparative Example 4 | 13 | 0.04 | 1 | 1.5 | 70 | 2 | 3 | A | AB | D |
| Comparative Example 5 | 14 | 0.71 | 1 | 1.5 | 70 | 2 | 97 | A | E | A |

As is obvious from Table 1, it is found that when using the toners according to the examples, scratches and partial wear of the cleaning blade are suppressed from being caused in comparison to the comparative examples.

In addition, according to Examples 1 to 38, it is found that excellent brilliance is obtained by adjusting the ratio (A/B) in a particular range.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic latent image developing toner comprising:

toner particles that contain a binder resin and a pigment; and an external additive that contains inorganic particles, wherein a ratio (C/D) of an average maximum thickness C of the toner particles to an average equivalent circle diameter D in the toner particles is from 0.05 to 0.7, the inorganic particles include silicone oil-treated inorganic particles in which the amount of free silicone oil with respect to the inorganic particles is from 0.1% by weight to 10% by weight, and the amount of the silicone oil-treated inorganic particles added with respect to 100 parts by weight of the toner particles is from 0.1 part by weight to 10 parts by weight.

2. The electrostatic latent image developing toner according to claim 1, wherein the electrostatic latent image developing toner satisfies the following formula:

$$0.1 \leq C/D \leq 0.6.$$

3. The electrostatic latent image developing toner according to claim 1, wherein the pigment has a flake-like shape.

4. The electrostatic latent image developing toner according to claim 1, wherein the number of pigment particles in which an angle between a long-axis direction of the toner and a long-axis direction of the pigment particles is from −30° to +30° is 60% or greater of all observed pigment particles, which are measured using a cross-section of the toner in a thickness direction.

5. The electrostatic latent image developing toner according to claim 1, wherein the number of pigment particles in which an angle between a long-axis direction of the toner and a long-axis direction of the pigment particles is from −30° to +30° is from 70% to 95% of all observed pigment particles, which are measured using a cross-section of the toner in a thickness direction.

6. The electrostatic latent image developing toner according to claim 1, wherein the electrostatic latent image developing toner satisfies the following formula:

$$2 \leq A/B \leq 100,$$

wherein A is reflectance at an acceptance angle of +30° that is measured when a solid image is formed with the electrostatic latent image developing toner and the image is irradiated with incident light at an incidence angle of −45° by the use of a variable-angle photometer, and B is reflectance at an acceptance angle of −30° that is measured when the image is irradiated with incident light at an incidence angle of −45° by the use of a variable-angle photometer.

7. The electrostatic latent image developing toner according to claim 6, wherein the electrostatic latent image developing toner satisfies the following formula:

$$20 \leq A/B \leq 90.$$

8. The electrostatic latent image developing toner according to claim 1, wherein the amount of silicone oil for treating the inorganic particles is from 1.0% by weight to 30% by weight.

9. An electrostatic latent image developer comprising:

the electrostatic latent image developing toner according to claim 1.

10. The electrostatic latent image developer according to claim 9, wherein the electrostatic latent image developing toner satisfies the following formula:

$$0.1 \leq C/D \leq 0.6.$$

11. A process cartridge for an image forming apparatus comprising:

an image holding member; and a developing section that develops an electrostatic latent image formed on a surface of the image holding member using a developer to form a toner image, wherein the developer is the electrostatic latent image developer according to claim 9.

12. The process cartridge for an image forming apparatus according to claim 11, wherein the electrostatic latent image developing toner satisfies the following formula:

$$0.1 \leq C/D \leq 0.6.$$

13. A toner cartridge comprising:

a toner accommodation chamber, wherein the toner accommodation chamber contains the electrostatic latent image developing toner according to claim 1.

14. The toner cartridge according to claim 13, wherein the electrostatic latent image developing toner satisfies the following formula:

$$0.1 \leq C/D \leq 0.6.$$

15. An image forming apparatus comprising:

an image holding member;

a charging device that charges a surface of the image holding member;

a latent image forming device that forms an electrostatic latent image on a charged surface of the image holding member;

a developing device that develops the electrostatic latent image as a toner image with the electrostatic latent image developing toner according to claim 1;

a transfer device that transfers the toner image formed on the surface of the image holding member onto a recording medium;

a fixing device that fixes the toner image transferred onto the recording medium; and a cleaning device that has a cleaning blade that is brought into contact with the surface of the image holding member to clean the surface.

16. The image forming apparatus according to claim 15, wherein the electrostatic latent image developing toner satisfies the following formula:

$$0.1 \leq C/D \leq 0.6.$$

17. An image forming method comprising:

charging a surface of an image holding member;

forming an electrostatic latent image on the surface of the image holding member;

developing the electrostatic latent image with the electrostatic latent image developing toner according to claim 1 to form a toner image;

transferring the developed toner image onto a recording medium;

fixing the toner image transferred onto the recording medium; and cleaning with a cleaning blade that is brought into contact with the surface of the image holding member to clean the surface.

18. The image forming method according to claim 17, wherein the electrostatic latent image developing toner satisfies the following formula:

$$0.1 \leq C/D \leq 0.6.$$

19. The electrostatic latent image developing toner according to claim 1, wherein the silicone oil is selected from the group consisting of a dimethyl silicone oil, an alkyl-modified silicone oil, an amino-modified silicone oil, a carboxylic acid-modified silicone oil, an epoxy-modified silicone oil, a fluorine-modified silicone oil, an alcohol-modified silicone oil, a polyether-modified silicon oil, a methylphenyl silicone oil, a methyl hydrogen silicone oil, a mercapto-modified silicone oil, a higher fatty acid-modified silicone oil, a phenol-modified silicone oil, a methacrylic acid-modified silicone oil, and a methylstyryl-modified silicone oil.

* * * * *